US012654064B2

(12) United States Patent
Hafke

(10) Patent No.: US 12,654,064 B2
(45) Date of Patent: Jun. 16, 2026

(54) PROFILE FOR A BALANCE BOARD

(71) Applicant: Christopher Kyle Hafke, Wheaton, IL (US)

(72) Inventor: Christopher Kyle Hafke, Wheaton, IL (US)

( * ) Notice: Subject to any disclaimer, the term of this patent is extended or adjusted under 35 U.S.C. 154(b) by 262 days.

(21) Appl. No.: 18/515,791

(22) Filed: Nov. 21, 2023

(65) Prior Publication Data

US 2025/0161746 A1 May 22, 2025

(51) Int. Cl.
*A63B 22/16* (2006.01)

(52) U.S. Cl.
CPC ..... *A63B 22/16* (2013.01); *A63B 2208/0204* (2013.01)

(58) Field of Classification Search
CPC ..... A63B 2208/0204; A63B 22/16
See application file for complete search history.

(56) References Cited

U.S. PATENT DOCUMENTS 3,604,726 A * 9/1971 Tracy ..... A63C 17/016 482/77
3,895,794 A * 7/1975 England ..... A63B 22/16 482/146
4,191,371 A * 3/1980 Armer, Jr. ..... A63B 22/18 482/77
5,545,115 A * 8/1996 Corcoran ..... A63B 22/16 482/146
D385,318 S * 10/1997 Videtto ..... D21/688
5,897,474 A * 4/1999 Romero ..... A63B 22/14 482/79
7,300,392 B1 * 11/2007 Curran ..... A63B 22/18 482/146
8,062,199 B2 * 11/2011 Smith ..... A63B 22/16 482/146
8,888,669 B2 * 11/2014 Dunegan ..... A63B 23/1236 482/141
9,044,634 B2 * 6/2015 Hjelt ..... A63B 21/00196
D741,961 S * 10/2015 Maribona ..... D21/684
9,387,363 B1 * 7/2016 Polinsky ..... A63B 26/003
D792,532 S * 7/2017 Olson ..... D21/662
11,097,153 B1 * 8/2021 Lee ..... A63B 22/18
2012/0252645 A1 * 10/2012 Agostini ..... A63B 22/18 482/132
2020/0238135 A1 * 7/2020 Stehlik ..... A63B 22/18
2023/0149773 A1 * 5/2023 Defore ..... A63B 22/18 482/146

* cited by examiner

*Primary Examiner* — Zachary T Moore

(57) ABSTRACT

A balance board profile has an upper profile surface and a lower profile surface axially space from the upper profile surface. A channel depends upwardly from the lower profile surface. The balance board profile may be attached to a balance platform to form a balance board. The channel in the profile may have safety features.

25 Claims, 23 Drawing Sheets

(ROTATED)

ROTATED

ROTATED

PROFILE FOR A BALANCE BOARD

RELATED APPLICATIONS

None

BACKGROUND OF THE INVENTION

Balance is essential in everyday life and especially important for athletes. Using a balance board can aid in building strength and enhancing flexibility. Standing on and working with a balance board can improve coordination, motor skills and lower extremity strength.

There are many different types of balance boards: some roll back and forth, some rock side to side and some just wobble around a rounded surface. However, balance boards are made to do one of the types of motion previously mentioned, therefore, to gain the full benefit of working with a balance board, a user would need multiple balance boards. In addition, balance boards that roll back and forth or roll side to side often have a ball or roller that is capable of travelling outside of the perimeter of the balance board, potentially causing injuries and falls.

Balance boards often come as a complete, non-separable apparatus which potentially increases the cost to the user. In addition, the user and the balancing surface may not work well with the user's balance needs.

Thus, a need exists for a profile with a channel where the profile can be attached to any user provided balancing surface. The profile will allow the user to perform multiple balance board functions in safer more controlled manner. In addition, the profile can be adapted for a variety of versatile applications.

SUMMARY OF THE INVENTION

According to one aspect of the invention, a balance board has a platform body with a bottom platform panel and a top platform panel. A channel is formed in the bottom platform panel and depends upwardly from the bottom platform panel. At least a portion of the channel is at the balance midpoint and in alignment with a longitudinal axis. The channel has a curvature so that a balance object can at least partially fit in the channel and move longitudinally within the channel.

In another aspect of the invention, a balance board profile has an upper profile surface and a lower profile surface axially space from the upper profile surface. A channel depends upwardly from the lower profile surface. At least a portion of the channel is at the balance midpoint and in alignment with a longitudinal axis. The channel has a curvature so that a balance object can at least partially fit in the channel and move longitudinally within the channel.

In a further aspect of the invention, a balance board profile has an upper profile surface and a lower profile surface axially space from the upper profile surface. A channel depends upwardly from the lower profile surface and the channel has two longitudinal sides and two lateral sides and many channel layers. The channel layers are placed such that the balance objects move towards the center layer.

In a further related aspect of the invention, a balance board system has a platform body with an upper platform surface and a lower platform surface. A profile is removably attached to at least a portion of the lower platform surface. A channel depends upwardly from a lower profile surface. At least a portion of the channel is disposed at a balance midpoint. A balance object is used in the channel.

BRIEF DESCRIPTION OF THE DRAWINGS

Further aspects of the invention and their advantages can be discerned in the following detailed description, in which like characters denote like parts and in which.

DETAILED DESCRIPTION

Figure 1A:
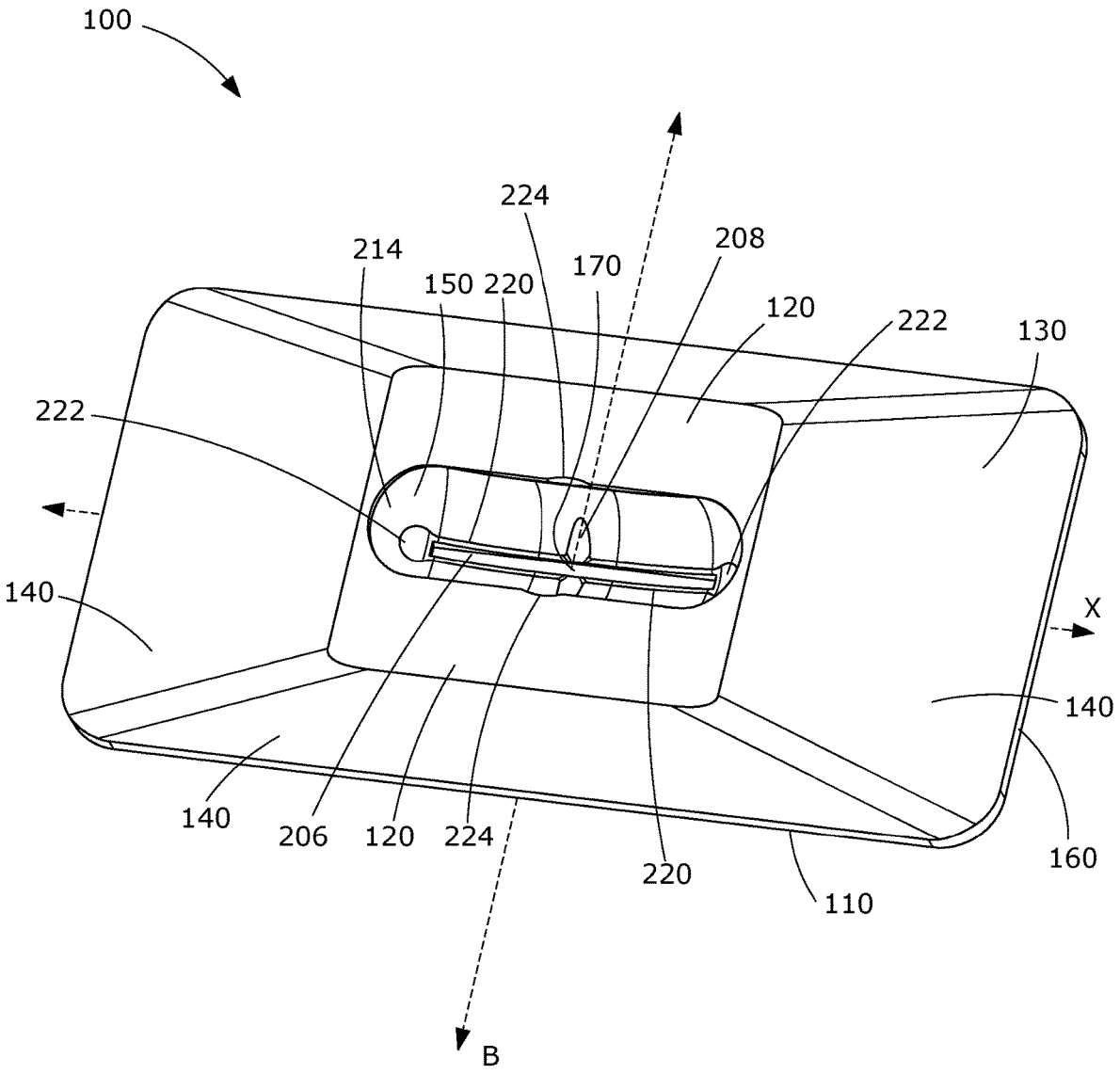
FIG. 1A is a bottom isometric view of a balance board with a channel according to the invention.

The present invention provides a channel 150 integrally formed in a balance board 100 for balancing on a balance object such as a ball or other substantially spherical object. In the illustrated embodiment shown in FIG. 1A, a balance board (shown bottom side up) indicated generally at 100 includes a platform body 130. The platform body 130 has a balance midpoint 170 substantially in alignment with a vertical axis or balance axis B. The balance midpoint 170 is located at the approximate center of gravity of the platform body 130 or the point at which the platform body 130 would be in a state of equilibrium if balanced at that point.

The platform body 130 has a substantially planar bottom platform panel 120 and a top platform panel 110 axially spaced from and opposed to the bottom platform panel 120. The top and bottom platform panels 110, 120 are substantially perpendicular to the vertical axis or balance axis B. In the illustrated embodiment the top and bottom platform panels 110, 120 are substantially rectangular with rounded corners and the bottom platform 120 panel is smaller than the top platform panel 110. In the illustrated embodiment of FIG. 1, the top platform panel 110 may have a length of approximately twenty-four inches and a width of approximately twelve inches and the bottom platform panel 120 may have a length of approximately ten inches and width of approximately eight inches. In alternate embodiments the top and bottom platform panels 110, 120 may have different dimensions and/or shapes. The dimensions and/or shapes of the top and bottom platform panels 110, 120 are determined by the application of the balance board 100.

In the illustrated embodiment, the platform body 130 has at least one sidewall 160 substantially parallel to the balance axis. The sidewall 160 joins the top platform panel 110 to a transitional panel 140. A transitional panel 140 is disposed at an angle to the bottom platform panel 120 preferably between zero and ninety degrees. In the illustrated embodiment the angle between the transitional panel 140 and the bottom platform panel 120 is approximately fourteen degrees. In the illustrated embodiment one sidewall 160 joins the top platform panel 110 to the transitional panel 140. In alternate embodiments there may be more than one sidewall 160 and more than one transitional panel 140. In yet further embodiments there may be four sidewalls 160 and four transitional panels 140.

Figure 2:
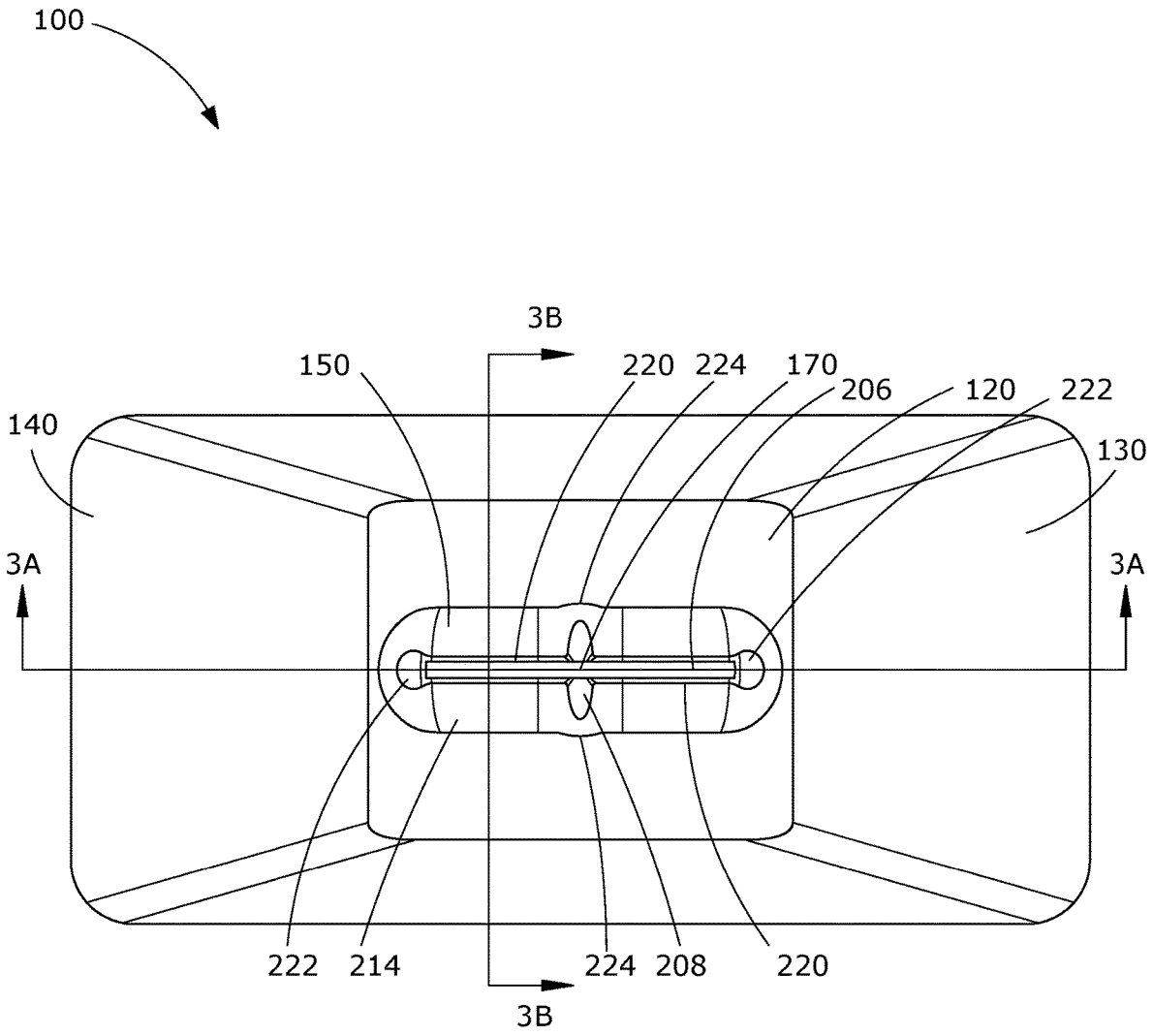
FIG. 2 is a bottom plan view of the balance board shown in FIGS. 1A and 1B.

A channel 150 depends upwardly from the bottom platform panel 120. At least a portion of the channel 150 encompasses the balance midpoint along the vertical or balance axis B. As illustrated in FIG. 2, the channel 150 is substantially a pill shape when observed in planar alignment with the bottom platform panel 120. The channel 150 extends along a longitudinal axis which is perpendicular to the vertical or balance axis.

Figure 1B:
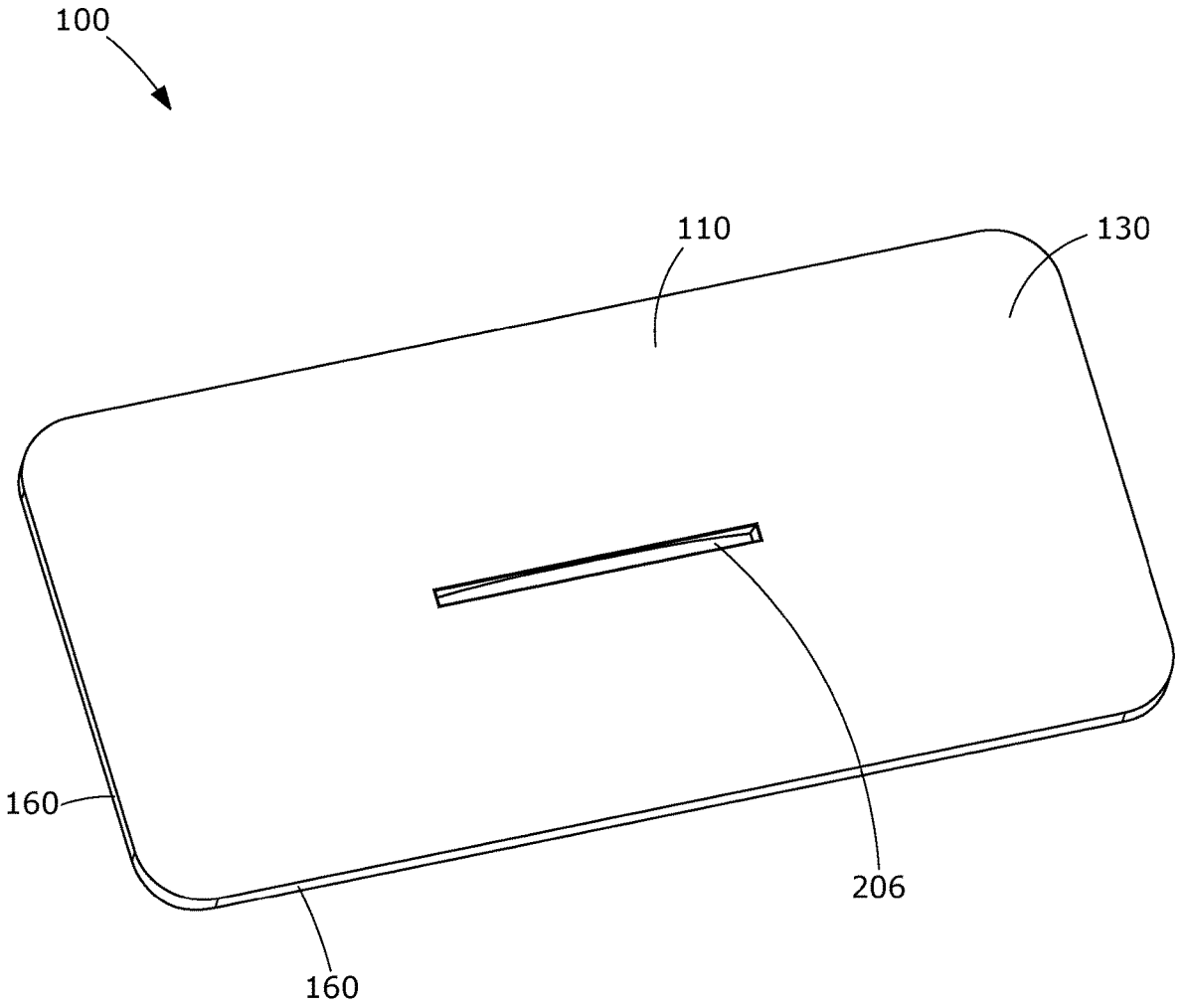
FIG. 1B is a top isometric view of the balance board shown in FIG. 1A.

FIG. 1B illustrates the top platform panel 110. In operation a user stands on the top platform panel 110 to balance on the balance board 100 when a balance object or ball is place in the channel 150. The top platform panel 110 may have foot placement markings that are textured, painted, taped or any other method that produces satisfactory results. A viewing slot 206 is disposed on the top platform panel 110 and will be discussed in further detail below.

As illustrated in FIG. 2, the perimeter of the channel 150 has two opposing substantially straight perimeter sections and two opposing curved perimeter sections. A curved channel wall 214 joins the straight and curved perimeter sections. The curvature of the channel wall 214 forms a substantially partial capsule shape similar to the pill shape perimeter being rotated on an axis of symmetry that bisects the two curved perimeter sections at either end of the channel 150. The curvature of the channel wall 214 is sized to accept a preselected group of balance objects or balls with predetermined diameters where at least a portion of the balance object or ball is retained in the channel. When in use, the movement of the balance object or ball in the channel 150 is in alignment with the longitudinal axis with preferably minimal lateral movement. Further embodiments may have channels 150 that accept non-spherical balance objects.

The channel 150 may have one or more features that increase the safety of the balance board 100 and accelerate the user's athletic development by honing in on the balancing skills. All, some, or none of these features may be included in further embodiments.

The embodiment illustrated in FIG. 2 has a viewing slot 206 disposed in the channel 150. The viewing slot 206 is disposed longitudinally in at least a portion of the curved channel wall 214. The viewing slot 206 extends through the platform body 130 (See FIG. 1B) and allows the user to observe the balance object or ball as the position of the ball changes with the angular repositioning of the balance board 100. The viewing slot 206 in the illustrated embodiment is approximately nine inches long and 0.25 inches wide, however, any viewing slot 206 length and width that produces acceptable results can be used. The viewing slot 206 may be an empty slot or absence of material or the viewing slot 206 may be filled with any transparent material that produces acceptable results. The viewing slot 206 may consist of a series of holes or openings rather than being a continuous opening.

For stability the curved channel wall 214 illustrated in FIG. 2 has two longitudinal indentations or stability grooves 220 on either side of the viewing slot 206 or any location in which acceptable results are achieved. The placement of the stability grooves 220 in this area allows the balance object or ball to have multiple points of contact with the curved channel wall 214, instead of just one. Having more than one point of contact between the balance object or ball and the channel 150 provides additional stability for ball movement and consequently stability for the balance board 100. In the illustrated embodiment each of the stability grooves 220 are approximately 0.125 inch wide and 8.5 inches long. In the illustrated embodiment the overall width of the stability grooves 220 and viewing slot 206 is approximately 0.5 inch. Alternate embodiments may have stability grooves 220 with different sizes.

The channel 150 has a center rest 208. The center rest 208 is a partial spherical dome indentation disposed on the curved channel wall 214 encompassing at least the balance midpoint 170 of the channel 150. In the illustrated embodiment the approximate midpoint of the center rest 208 aligns with the vertical or balance axis. The center rest 208 provides a position in which the balance object or ball can be in a semi-stationary position while in the channel 150. Being semi-stationary in the channel 150 is a safety feature as it promotes stability of the balance board 100 for the user while the balance board 100 is in use and provides stability for the user when getting on or off the balance board 100. A small amount of force is necessary to move the balance object or ball from the center rest 208 into the other areas of the channel 150. The amount of force necessary is dependent on the depth of the center rest 208—a deeper center rest 208 requires more force and a shallower center rest 208 requires less force.

The center rest 208 slows the movement of the balance board 100 as the balance object or ball traverses the channel 150 longitudinally. When traversing the channel 150 longitudinally, the balance object or ball will come to rest or pause in the center rest 208 and can be manipulated out of the center rest 208 by the user. The center rest 208 may have any dimensions that produce acceptable results however preferably the center rest 208 is proportional to and has a curvature that is substantially similar to the curvature of the ball being used in that specific channel 150.

An insertion indent 224 is disposed on the bottom platform panel 120 contiguous with each of the straight perimeter sections of the channel 150. The insertion indent 224 consists of two arcuate cut outs, each disposed on opposing straight perimeter sections 210 in alignment with the approximate midpoint of channel 170. The insertion indent 224 is used for inserting and removing the balance object or ball from the channel 150. Having a single point of entry and exit for the balance object or ball into the channel 150 helps prevent falls and abrupt repositions. In the illustrated embodiment the maximum width of insertion indent 224 is approximately 3.124 inches and the lateral width of the channel (outside the area of the insertion indent 224) is approximately 3 inches as measured on the bottom platform panel 120. Accordingly, the optimal diameter of the balance object or ball used with the illustrated channel 150 would have a diameter of less than 3.124 inches and greater than approximately 2.5 inches. A balance object or ball with a diameter of approximately 3 inches would be a preferred diameter for the illustrated channel 150. Alternate embodiments may have channels 150 that accept a variety of balance object of ball diameters.

Two channel rests 222 are disposed in each end of the curved channel wall 214 adjacent the curved perimeter sections. Each channel rest 222 is a partial spherical dome indentation formed in the upper part of the curved channel wall 214 in alignment with the center rest 208 and the stability grooves 220. The channel rests 222 help slow the balance object or ball as it reaches the ends of the channel 150. The channel rests 222 may have any dimensions that produce acceptable results however preferably the channel rests 222 have a curvature that is substantially similar to the curvature of the ball being used in that specific channel 150 so that the ball nests in the channel rests 222. Like the center rest 208, a small amount of force may be necessary to move the balance object or ball from the channel rests 222. The amount of force necessary is dependent on the depth of the channel rests 222—deeper channel rests 222 require more force and more shallow channel rests 222 require less force.

Figure 3A:
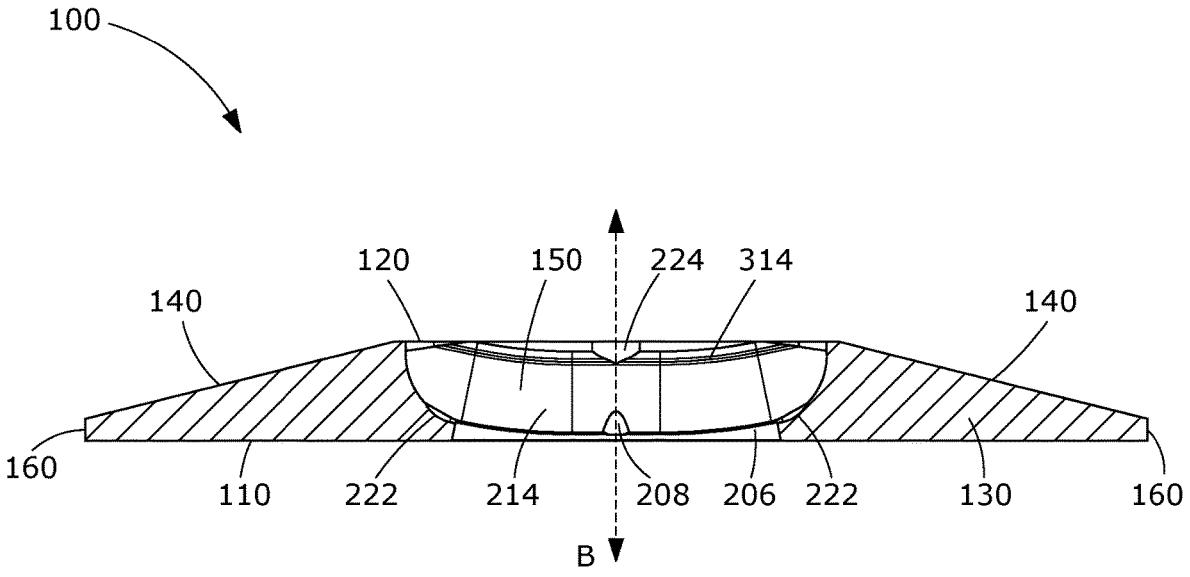
FIG. 3A is a sectional view taken substantially along the line 3A-3A of FIG. 2.

A longitudinal cross-section of the balance board 100 (lower side up) is illustrated in FIG. 3A. The uppermost curved channel wall 214 follows a substantially elliptical path rather than a straight line perpendicular to the balance axis. During use the balance object or ball follows the elliptical path of the curved channel wall 214 and slows down as a function of the elliptical path as it longitudinally travels in the channel 150. The movement of the balance object along the elliptically curved channel wall 214 is not only is a safety feature but also aids in maintaining a speed at which the user can continue to balance on the board as the weight of the user shifts. The elliptical curve of the curved channel wall 214 prevents the ball from coming to an abrupt jarring stop as it reaches the ends of the channel 150 and provides a more natural movement that helps increase the balance skills of the user. In addition, the elliptical curve of the channel wall 214 works in conjunction with the channel rests 222 to provide a safe and controllable experience for the user.

A retention ridge 314 is disposed in the curved channel wall 214 as shown in FIG. 3A. The retention ridge 314 is essentially a continuous ridge on the curved channel wall 214 that projects into the channel 150 a predetermined distance. The retention ridge 314 helps to prevents the balance object or ball from exiting the channel 150 outside of the insertion indent 224. The retention ridge 314 ensures the balance object or ball of a preselected range of diameters remains in the channel 150 while the balance board 100 is in use which enhances safety for the user. When a balance object or ball of a preselected range of diameters is used in the channel 150, over half of the balance object or ball will be inside the channel 150 and the retention ridge 314 will align with the balance object or ball at a section that is smaller than its maximum diameter. As illustrated the retention ridge 314 follows the elliptical curvature of the channel wall 214.

For balance skill development, the optimal balance object or ball chosen for the channel 150 should have a diameter that creates minimal transverse motion and unencumbered longitudinal movement in the channel 150. The diameter of the balance object or ball must be one that allows it to roll freely on the ground when the balance board 100 is in use. If a balance object or ball does not extend past the bottom platform panel 120 and the user would not be able to balance on the balance object or ball when the channel is in use.

Figure 3B:
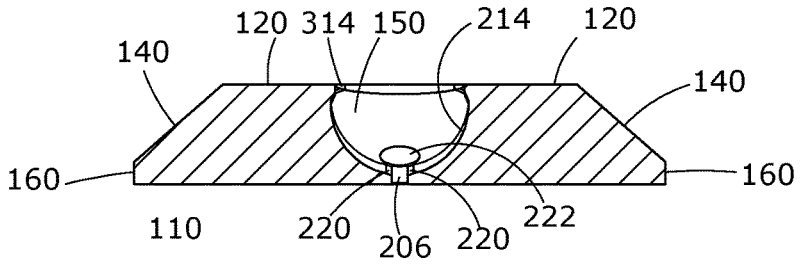
FIG. 3B is a sectional view taken substantially along the line 3B-3B of FIG. 2.

In the cross-sectional view illustrated in FIG. 3B, a lateral cross-section of the balance board 100 (lower side up). The curved channel wall 214 does not necessarily follow the shape of a major circular arc and does not necessarily conform or nest with the shape of the balance object or ball. The illustrated embodiment allows for the balance object or ball to have several touch points with the curved channel wall 214. In alternate embodiments the curved channel wall 214 may have an elongated, flattened top to aid in stability. In yet further embodiments the curved channel wall 214 may follow a circular arc.

As illustrated the curved channel wall 214 is substantially smooth. Alternate embodiments may have curved channel walls 214 with a texture that could be in the form of bumps, spikes, or other irregular protrusions. Texture may be disposed in the curved channel wall 214 somewhat displaced from the midpoint 170 to aid in slowing or controlling the balance object or ball.

The balance board 100 may be made by thermoforming or cast in plastic or metal or injection molded, thermoformed, or any other process that produces acceptable results. If the balance board is thermoformed, ABS may be used. The balance board 100 must be able to support the user's weight. Any material or combination of materials may be used that produces acceptable results.

Figure 4:
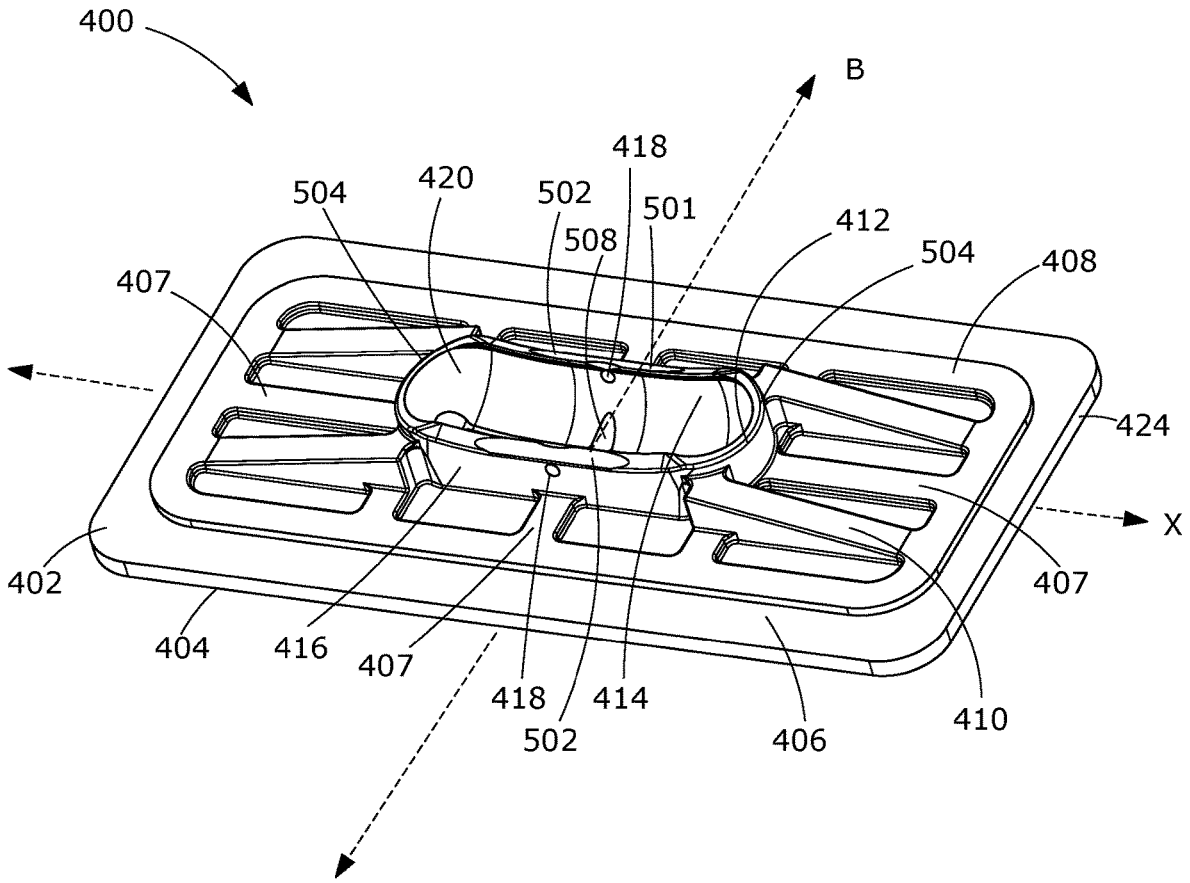
FIG. 4 is a bottom isometric view of an alternate balance board with a channel according to the invention.

The balance board embodiment illustrated in FIG. 4 is a balance board 400 (viewed from the bottom) with a platform body 402 having a top platform panel 404 and a bottom platform panel 406 axially spaced from and opposed to the top platform panel 404. The top and bottom platform panels 404, 406 are substantially perpendicular to the vertical or balance axis B. The dimensions and/or shapes of the top and bottom platform panels 404, 406 are determined by the application of the balance board 400. In the illustrated embodiment the top and bottom platform panels 404, 406 are substantially rectangular with rounded corners. In the illustrated embodiment of FIG. 4, the top and bottom platform panels 404, 406 may have a length of approximately twenty-four inches and a width of approximately twelve inches. In alternate embodiments the top and bottom platform panels 404, 406 may have different dimensions and/or shapes. At least one sidewall 424 joins the top and bottom platform panels 404, 406. In the illustrated embodiment of FIG. 4, the sidewall 424 has a height of approximately 0.5 inches. Alternate embodiments may have a sidewall 424 of a different height.

A profile 412 depends downwardly from the bottom platform panel 406. The profile 412 is substantially pill shaped when viewed perpendicular to the vertical or balance axis. The size of the profile 412 is application dependent however, the profile 412 must be adequately sized to contain a channel 414 and have the structural stability necessary to achieve the range of motion desired for the balance board 400. An outer profile wall 416 joins the bottom platform panel 406 and extends downwardly from the bottom platform panel 406.

Support ribs 407, 408, 410 are integrally molded with the platform body 402. In the illustrated embodiment there is a circumferential support rib 408 that is inset a uniform distance from the outside edge of the bottom platform panel 406. The circumferential support rib 408 has a substantially rectangular shape with curved corners, following the shape of the bottom platform panel 406. Additional support ribs 407 extend at right angles from the circumferential support rib 408, forming a grid or hash pattern. In the illustrated embodiment each of the support ribs 407, 408 has a uniform width of approximately 1.0 inches and a height of approximately 0.25 inch. In alternate embodiments the support ribs 407, 408 may have varying widths and/or a width greater or less than 1.0 inches and varying heights and/or a height greater or less than 0.25 inches.

Four substantially triangular support ribs 410 (as viewed from the side) extend from circumferential support rib 408 to the outer profile wall 416. Alternate embodiments may have more or less than four triangular support ribs 410. As illustrated, each of the triangular support ribs 410 have a width of approximately 1.0 inches and a maximum height of approximately 1.5 inches. The height is measured in alignment with the vertical or balance axis as measured from support rib 408, 407 to the intersection of the triangular support rib 410 and the outer profile wall 416. Alternate embodiments may have a different pattern of support ribs 407, 408, 410. Any support rib 407, 408, 410 configurations may be used as long as it provides adequate stability for a user to stand on the top platform panel 404 and use the balance board 400 for its intended purpose.

The illustrated profile 412 has two stability rod holes 418 on opposing sides of the outer profile wall 416 approximately in alignment with a vertical or balance axis B. Alternate embodiments may not have stability rod holes 418. The stability rod holes 418 are discussed in further detail in reference to FIG. 6A below.

Figure 5:
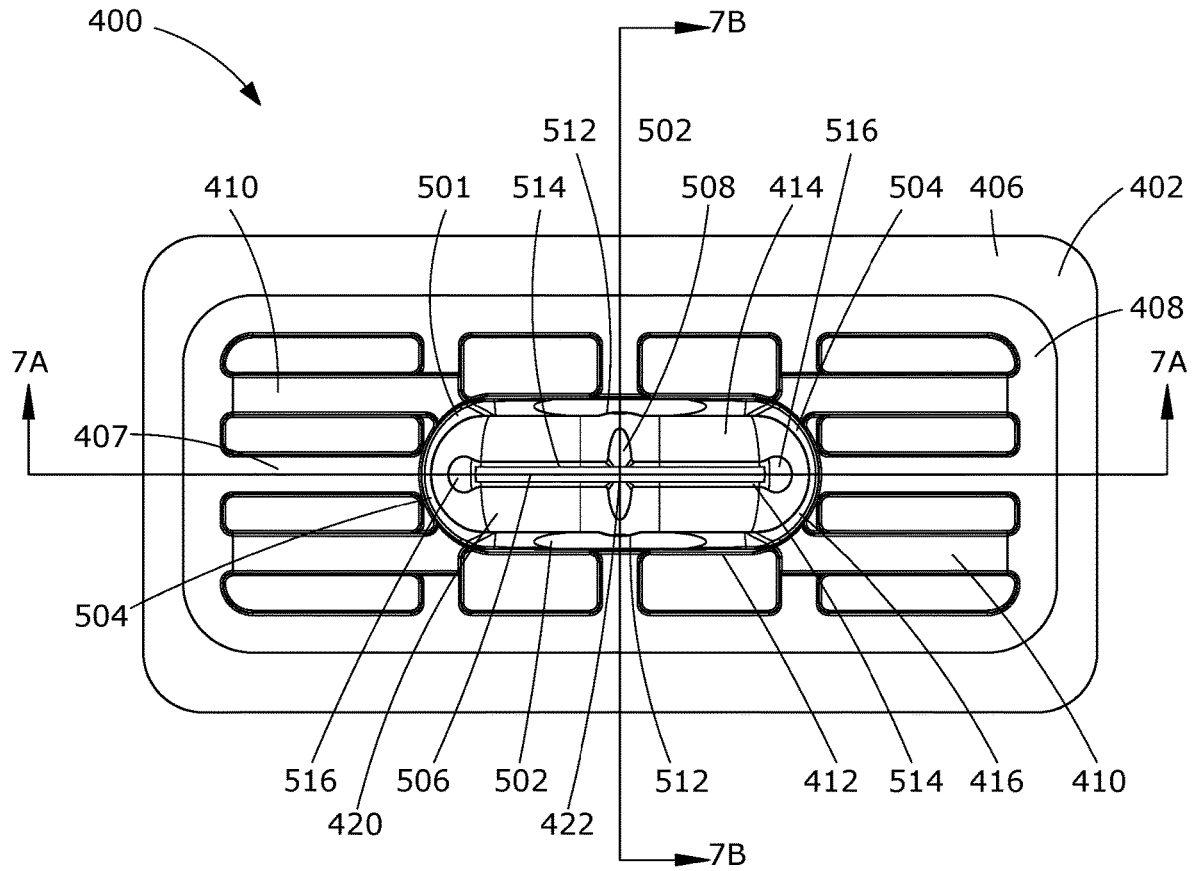
FIG. 5 is a bottom plan view of the balance board shown in FIG. 4.

As illustrated in FIG. 5, The platform body 402 has a balance midpoint 422 substantially in alignment with the vertical axis or balance axis B. The balance midpoint 422 is located at the approximate location of the platform body's 402 center of gravity or the point at which the platform body 402 would be in a state of equilibrium if balanced at that point.

A channel 414 depends upwardly from a lower profile surface 501 in alignment with a longitudinal axis (See FIG. 4). At least a portion of the channel 414 encompasses the balance or vertical axis and balance midpoint 422. The lower profile surface 501 has two straight lower profile surface sections 502 and two curved lower profile surface sections 504. A continuous curved channel wall 420 joins the straight lower profile surface sections 502 and the curved lower profile surface sections 504. The curvature of the channel wall 420 is sized to accept a preselected group of balance objects or balls with predetermined diameters where at least a portion of the balance object or ball is retained in the channel 414. Channels 414 of different sizes accommodate different size ranges of balance objects or balls. Various sizes of channels 414 may be formed in identically sized profiles 412 or the profiles 412 may be proportionally sized to the varying sizes of channels 414. In use, the movement of the balance object or ball in the channel 414 is longitudinal with preferably minimal lateral movement.

The channel 414 may be featureless, in essence a smooth continuous curved wall 420. Alternate embodiments may have curved channel walls 414 with a texture that could be in the form of bumps, spikes, or other irregular protrusions. Texture may be disposed in the curved channel wall 420 somewhat displaced from the midpoint 422 to aid in slowing or controlling the balance object or ball.

The channel 414 may have several features that increase the safety for the user of the balance board 400 and accelerate the user's athletic development by honing in on the balancing skills. The features may be present or not present in any combination in alternate embodiments of a channel 414. The channel 414 illustrated in the embodiment of FIG. 5 has a viewing slot 506 (as discussed above) that extends through the platform body 402. The channel 414 illustrated in the embodiment of FIG. 5 also has a center rest 508 (as discussed above).

For stability the channel 414 illustrated in FIG. 5 has two longitudinal indentations or stability grooves 514 on either side of the viewing slot 506. If there is no viewing slot 506, the stability grooves 514 are longitudinally disposed on the channel wall 420 slightly offset from the uppermost part of the channel wall 420 or wherever acceptable results are achieved. In the illustrated embodiment the stability grooves 514 are approximately 0.125 inch wide and 8.5 inches long. In the illustrated embodiment the overall width of the stability grooves 514 and viewing slot 506 is approximately 0.5 inch.

An insertion indent 512 may be disposed on the lower profile surface 501. The insertion indent 512 consists of two arcuate cut outs 512, each disposed in each opposing straight lower profile surface sections 502 in approximate alignment with the vertical or balance axis. The insertion indent 512 is used for inserting the balance object or ball into the channel 414 and removing the balance object or ball from the channel 414. The insertion indent 512, together with the retention lip 702 (discussed below), helps prevent the balance object or ball from being displaced from the channel 414 during the use of the balance board 400. Having the insertion indent 512 function as a single point of entry and exit for the balance object or ball helps prevent the balance object or ball from exiting the channel 414 during balance board 400 use which could cause falls and abrupt repositions. For optimal use, the diameter of the balance object or ball should be less than the distance between opposing straight lower profile surface sections 502 (not including the insertion indent 512) to ensure the balance object or ball does not leave the channel 414 while the balance board 400 is in use. In the illustrated embodiment the width of insertion indent 512 is approximately 3.124 inches. Accordingly, the balance object or ball used with the illustrated channel 414 would have a diameter of less than 3.124 inches, optimally approximately three inches. As discussed above, the profile 412 and channel 414 may have different proportions to work with balance object or balls of a variety of sizes.

In the illustrated embodiment, a channel rest 516 is disposed in each longitudinal end of the channel wall 420. Each channel rest 516 is a partial spherical dome indentation located approximately the position of the balance object or ball when the balance object or ball is furthest from the balance axis. The channel rests 516 help the user by modulating the speed of the balance object or ball as the user's weight shifts. In addition, the channel rests 516 prevent or reduce abrupt jarring stops or rebounding motions. Similar to the center rest 508, a small amount of force is needed to move the balance object or ball from the channel rests 516. The amount of force is dependent on the depth of the channel rests 516—deeper channel rests 516 require more force and more shallow channel rests 516 require less force.

Figure 6A:
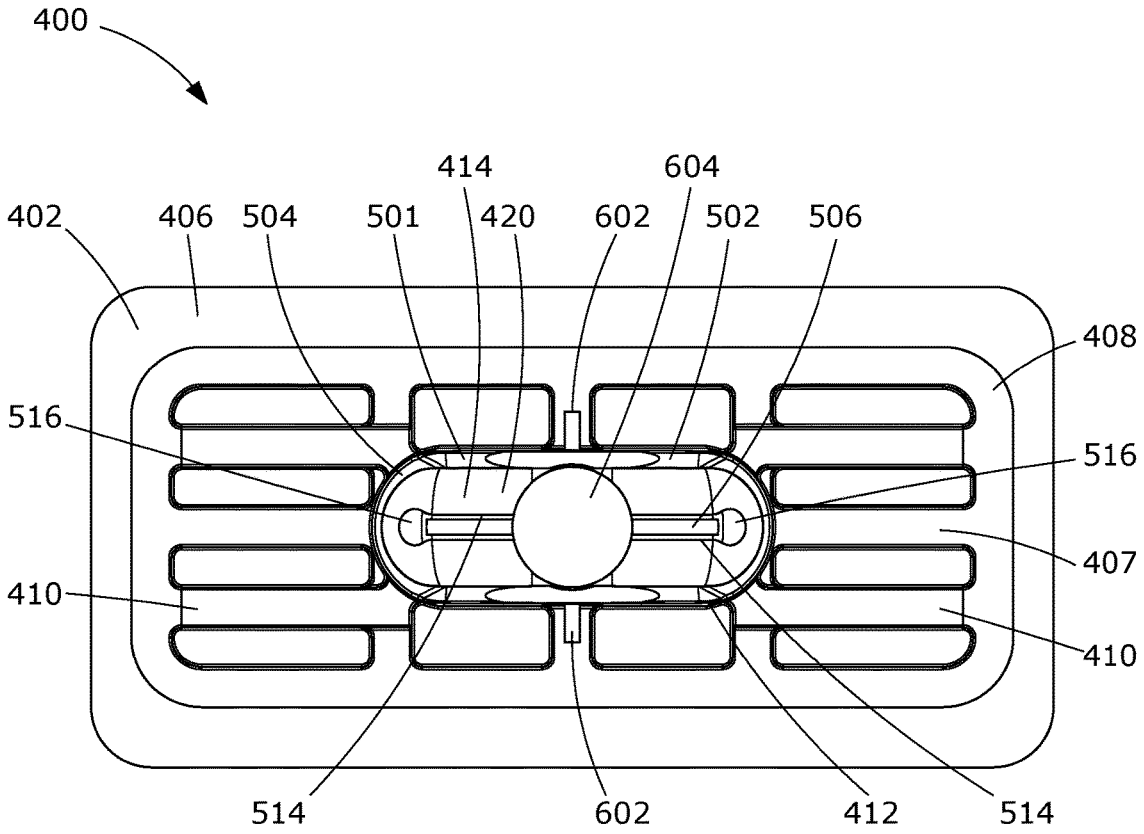
FIG. 6A is a bottom plan view of the balance board shown in FIGS. 4 and 5 with a retention rod and ball according to the invention.
Figure 6B:
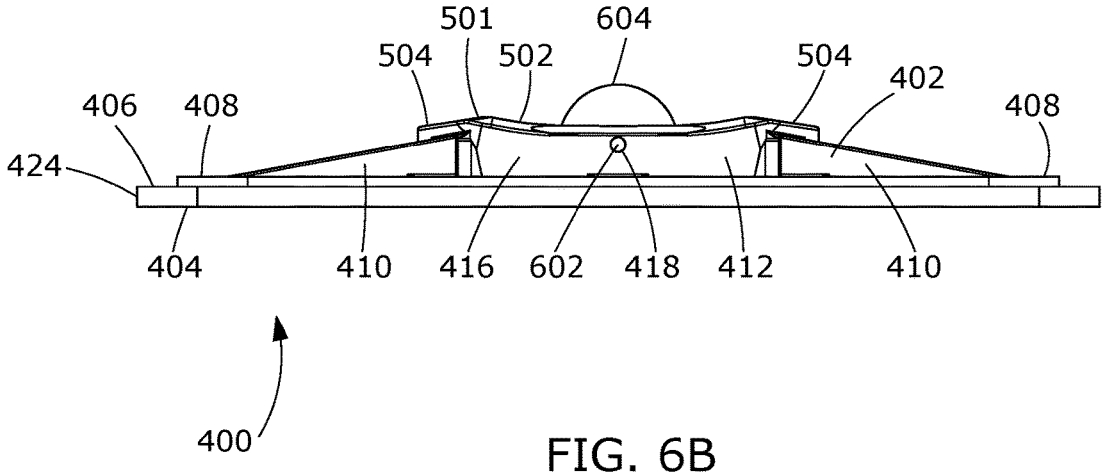
FIG. 6B is a side view of the balance board shown in FIGS. 4 and 5 with a retention rod and ball according to the invention.

The skills of the user may also be improved with stationary balancing on the balance board 400. During stationary balancing longitudinal movement of the balance object or ball in the channel 414 is prevented by using a stability rod 602 (See FIGS. 6A and 6B). As illustrated in FIGS. 6A and 6B, the stability rod 602 will traverse through a balance object or ball 604 with a corresponding hole. When used in this way, the stability rod 602 holds the balance object or ball 604 in place to allow stationary balancing on the balance object or ball without longitudinal movement. In the illustrated embodiment the stability rod holes 418 are in vertical alignment with the center rest 508 although a center rest 508 is not required for stationary balancing. In the illustrated embodiment the diameter of the stability rod holes 418 are approximately 0.375 inch. Preferably the diameter of the corresponding hole in the balance object or ball is approximately identical. Alternate embodiments may have stability rod holes 418 with different diameters as long as satisfactory results are achieved. As illustrated in FIG. 6B the balance object or ball 604 must have a diameter that allows it to extend past the lower profile surface 501 while the retention rod 602 is in place.

Figure 7A:
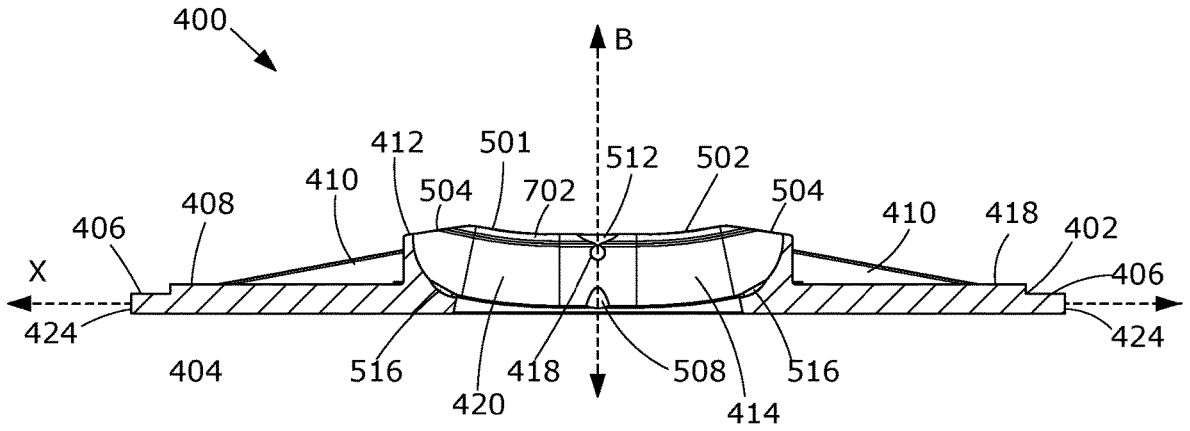
FIG. 7A is a sectional view taken substantially along the line 7A-7A of FIG. 5.

As illustrated in FIG. 7A, the cross-section of the uppermost portion of the channel wall 420 follows a somewhat elliptical path relative to the longitudinal axis. When in the channel 414, the balance object or ball traverses the elliptical path of the channel wall 420 which causes it to slow down as it nears the channel rests 516. The elliptical cross section of the channel wall 420 is not only a safety feature but also helps the user maintain a speed at which the user can balance on the board 400 as the user's weight shifts by preventing abrupt jarring stops. The elliptical shape ensures a more natural side-to-side or back-and-forth movement and helps increase the balance skills of the user. Alternate embodiments may have substantially flat uppermost portion of the channel wall 420.

As illustrated in FIG. 7A, the straight lower profile surface sections 502 mimic the slight elliptical shape of the channel wall 420. The angle of the curved lower profile surface sections 504 prevents the profile 412 from hitting the ground when the balance object or ball is positioned at either of the opposing longitudinal ends of the channel wall 420 without the diminishing the full range of the balance board 400. In alternate embodiments the entire lower profile surface 501 may be substantially coplanar.

Figure 7B:
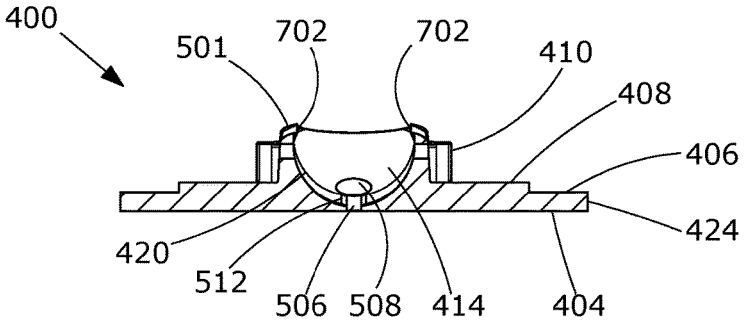
FIG. 7B is a sectional view taken substantially along the line 7B-7B of FIG. 5.

In the cross-sectional view illustrated in FIG. 7B, a lateral cross-section of the balance board 400, the balance object has several touch points with the curved channel wall 420. The channel wall 420 does not necessarily follow the shape of a major circular arc and does not mimic the shape of the balance object or ball. The placement of the stability grooves 514 in this area allows the ball to have at least two resting points on the channel wall 420 rather than just one resting point providing additional stability for ball movement and overall balance board 400. In the illustrated embodiment the stability grooves are approximately 0.125 inch wide and 8.5 inches long. In alternate embodiments the curved channel wall 420 may have an elongated, flattened top to aid in stability. In yet further embodiments the curved channel wall 420 may follow a circular arc or any shape that produces acceptable results.

A retention lip 702 may be disposed at the intersection of the lower platform surface 501 and the curved channel wall 420 as shown in FIG. 7B. The retention lip 702 is similar to the retention ridge 314 (See FIG. 3A) discussed above in that it prevents the balance object or ball from exiting the channel 414 outside of the insertion indent 512. When a balance object or ball of a preselected range of diameters is used in the channel 414, over half of the balance object or ball will be inside the channel 414 and the retention lip 702 will align with the balance object or ball at a section that is smaller than its maximum diameter.

Figure 8A:
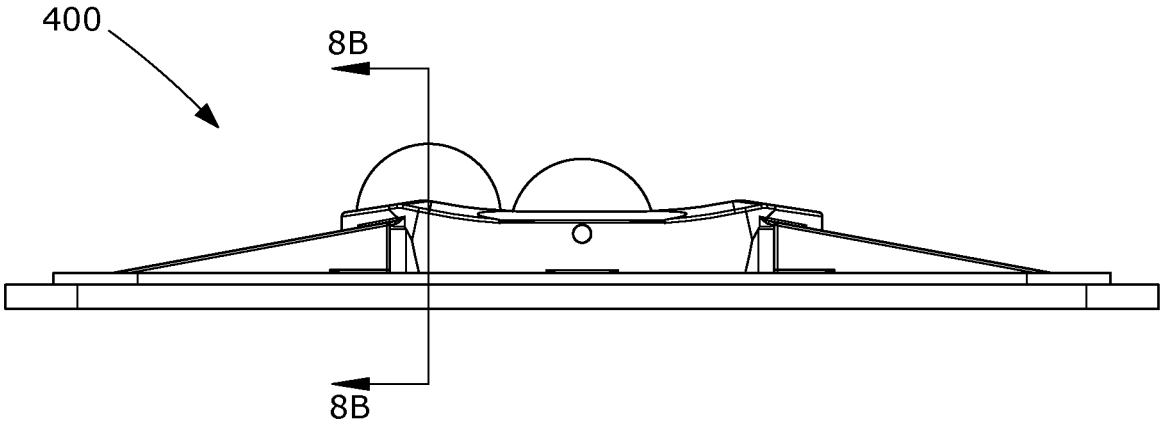
FIG. 8A is a side view of the balance board of FIGS. 4 and 5 with two balls present in a channel.
Figure 8B:
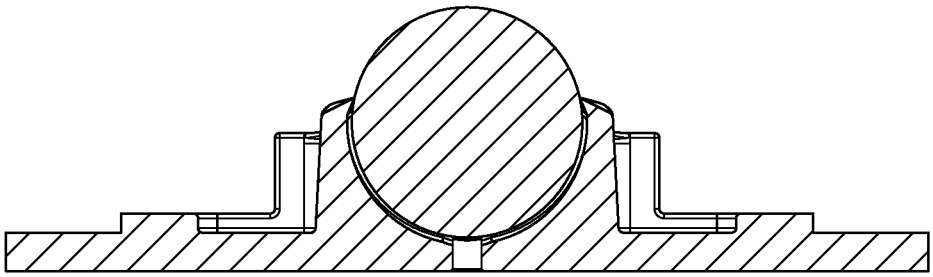
FIG. 8B is a sectional view taken substantially along the line 8B-8B of FIG. 8A.

FIG. 8A illustrates the balance board with two balls in the channel. 8B illustrates a cross sectional view taken at line 8B. In this illustration, the space between the channel wall and the ball at the location of the insertion indent. 8C illustrates the retention lip more clearly. As shown in the detail view the retention lip curves in to hold the ball in the channel. As illustrated ideally more than half of the ball is below the retention lip when the ball is in the channel.

The top of the balance board of FIG. 4 is substantially identical as illustrated in FIG. 1B. The top has a viewing slot which may be the identical length of the viewing slot in the corresponding channel or may be shorter. The top of the balance board may have a non-skid texture and additionally may have outlines for proper foot placement.

The balance board 400 may be made by thermoforming or cast in plastic or metal or injection molded, thermoformed, or any other process that produces acceptable results. If the balance board is thermoformed, ABS may be used. The balance board 400 must be able to support the user's weight. Any other material may be used that produces acceptable results.

The profile embodiments illustrated in FIGS. 9A-21B allow a profile to be removably or permanently attached to a platform body or balance platform thereby creating a balance board. By using removable profiles of varied shapes and/or sizes, the user can increase or decrease the level of difficulty of the balance board and/or change the skills practiced. In addition, the user can use a balance platform or platform body of his/her choosing adding additional opportunities to customize the level of difficulty and skill development. Acceptable platform bodies or balance platforms include, but are not limited to, plywood sheets cut to desired shape and size, skateboard decks, wood, plastic, or metal boards, or any other material that can support the users' weight and attach to a profile.

Figure 9A:
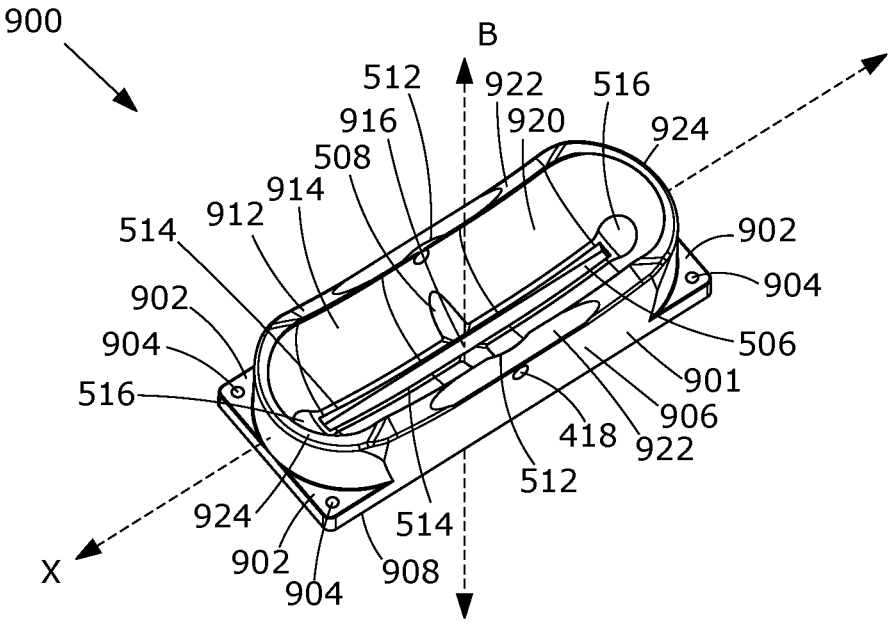
FIG. 9A is a bottom isometric view of a profile according to the invention.
Figure 10A:
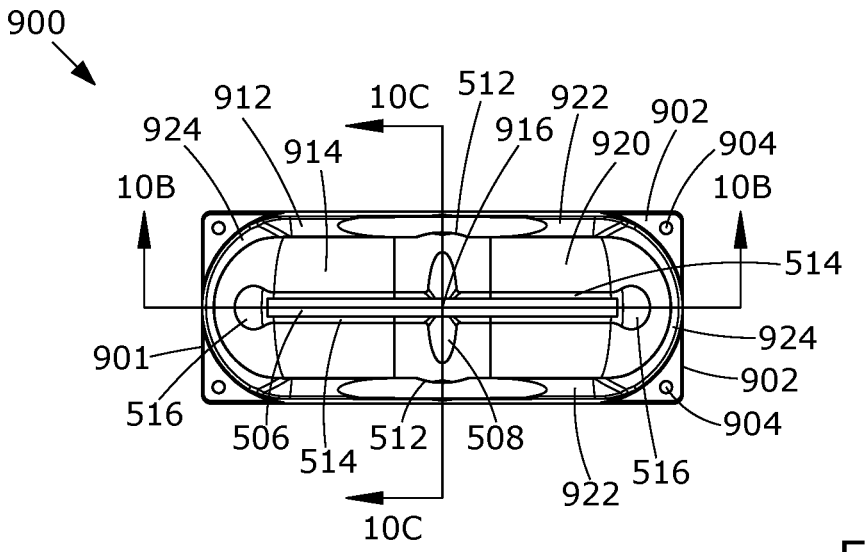
FIG. 10A is a bottom plan view of the profile shown in FIGS. 9A and 9B.

FIGS. 9A and 10A illustrate a profile 900 (shown from the bottom) that accepts a substantially spherical balance object or ball. As stated above, the profile 900 can be removably or permanently attached to a variety of platform bodies or balance platforms to form a balance board. A profile body 901 has a balance midpoint 916 substantially in alignment with the vertical axis or balance axis B. The balance midpoint 916 is located at the approximate location of the center of gravity or the point at which the profile body 901 would be in a state of equilibrium if balanced at that point.

Figure 9B:
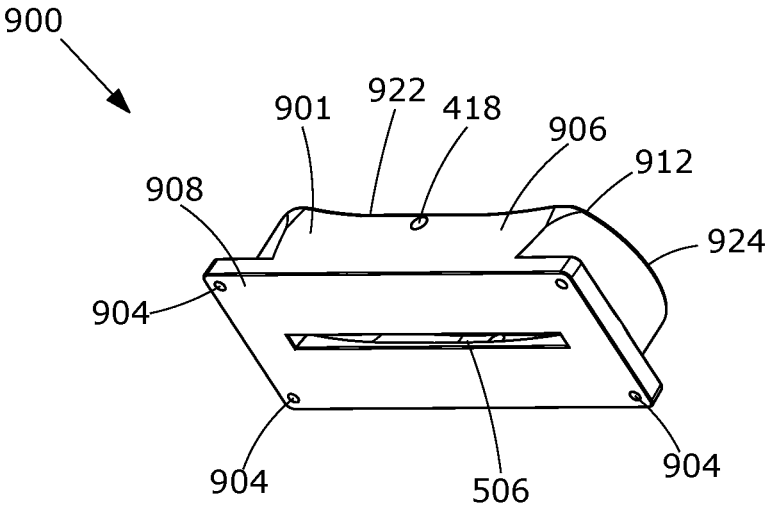
FIG. 9B is a top isometric view of the profile shown in FIG. 9A.

As illustrated in FIG. 9B, the profile body 901 has a substantially planar upper profile surface 908 that has a substantially rectangular shape and an outer profile wall 906 that is substantially rectangular shape with semi-circular ends or a pill shape. In the illustrated embodiment the upper profile surface 908 is approximately 10 inches long and 4 inches wide. Alternate embodiments may be larger or smaller so long as desired results are achieved.

The upper profile surface 908 includes four fastener wings 902, two disposed adjacent each semi-circular end of the outer profile wall 906. The holes of the fastener wings 902 may accept rivets, bolts, screws, nails, or any other connector that fastens the profile 900 to a selected balance platform or platform body. Any fastener that produces acceptable results may be used. In alternate embodiments, the upper profile surface 908 may be circular or ovoid or any other shape that provides acceptable results. Alternate embodiments may have more or fewer fastener wings 902 and the fastener wings 902 may be placed in different locations.

A channel 914 depends upwardly from a lower profile surface 912. At least a portion of the channel 914 encompasses the balance midpoint 916. The channel 914 is in alignment with a longitudinal axis. The lower profile surface 912 has two straight lower profile surface sections 922 and two curved lower profile surface sections 924. A continuous curved channel wall 920 joins the straight lower profile surface sections 922 and the curved lower profile surface sections 924. The channel 914 may be featureless, in essence a smooth continuous curved channel wall 920. As in the balance board channels described previously, the curvature of the channel wall 920 is sized to accept a preselected group of spherical balance objects or balls with predetermined diameters while retaining at least a portion of the balance object or ball in the channel 914 when the profile is in use. The channel 914 permits longitudinal movement of the balance object or ball with preferably minimal lateral movement. Channels 914 of different sizes accommodate different sizes of balance objects or balls, with corresponding diameter ranges. Various sizes of channels 914 may be formed in identically sized profiles 900 or the profiles 900 may be proportionally sized to the varying sizes of channels 914.

The channel 914 and profile 900 may have some, all or none of the features discussed above in reference to FIGS. 1-8B. The use, function and description are as described above. As illustrated the channel 914 has a viewing slot 506 that extends through the upper profile surface 908. The viewing slot 506 in the illustrated embodiment is approximately 8 inches long and 0.25 inches wide but alternate embodiments may have viewing slots 506 with different sizes. Stability grooves 514 are longitudinally disposed on either side of the viewing slot 506. Each stability groove is approximately 0.125 inches wide and 8 inches long. The span of the viewing slot 506 and the two stability grooves 514 is approximately 0.5 inch. Importantly, in instances where there is no viewing slot 506, the stability grooves 514 may still be present.

The channel 914 has a center rest 508 disposed approximately at the balance midpoint 916 and two channel rests 516 disposed at opposing ends of the channel 914. The channel 914 has an insertion indent 512 disposed on the lower profile surface 501. In the illustrated embodiment the width of insertion indent 512 is approximately 3.124 inches. Accordingly, the balance object or ball used with the illustrated channel 914 would have a diameter of less than 3.124 inches, optimally approximately three inches. As discussed above, the profile 900 and channel 914 may have different proportions to work with balance object or balls of a variety of sizes.

Two stability rod holes 418 are disposed through opposing profile walls 906 in approximate alignment with the balance axis. The stability rod holes 418 accept stability rods 602 (See FIG. 6) as described above in reference to FIG. 4. The stability rods 602 (See FIG. 6) hold a balance object or ball in place for stationary balancing.

FIG. 9B is the profile 900 as viewed from the top. In use, the upper profile surface 908 is adjacent the lower surface of a platform body or balance platform and would be connected at the fastener wings 902. For the viewing slot 506 to be functional, it would need to line up with an opening or transparent section on the balance platform or platform body to which the profile 900 is attached. Importantly the opening on the balance platform or platform body do not have to be identical in size or shape to the viewing slot 506. The holes of the fastener wings 904 are visible on the upper profile surface 908.

Figure 10B:
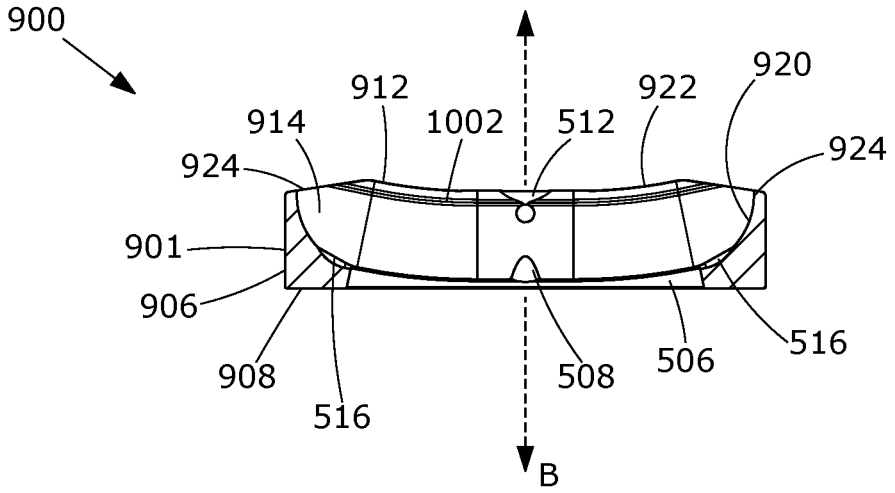
FIG. 10B is a sectional view taken substantially along the line 10B-10B of FIG. 10A.

As illustrated in FIG. 10B, similar to the channels illustrated in FIGS. 4-8B, the longitudinal cross-section of the uppermost portion of the channel wall 920 follows a somewhat elliptical path relative to the balance axis. In addition, the curved lower profile surface sections 924 are not coplanar with the straight lower profile surface sections 922. Portions of the curved lower profile surfaces 924 have an upward slope when compared to the upper profile surface 908. The slope ensures that the profile body 901 and/or platform body (when the profile body 901 is attached to a platform body) does not hit the ground when the balance object or ball is at either of the opposing longitudinal ends of the channel wall 920 without the diminishing the full range of the balance board. The straight lower profile surface sections 922 somewhat correspond to the elliptical slope of the channel wall 920.

Figure 10C:
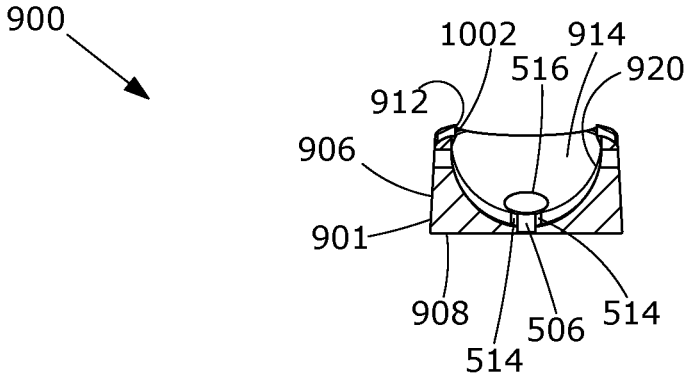
FIG. 10C is a sectional view taken substantially along the line 10C-10C of FIG. 10A.

In a cross-sectional view of the profile 900 illustrated in FIG. 10C, a retention lip 1002 is a protrusion at the intersection of the channel wall 920 and the straight lower profile surface section 922. The retention lip is approximately the same as the retention lip illustrated in FIGS. 4-8B. The retention lip 1002 helps maintain a balance object or ball of a preselected range of diameters in the channel 914. As explained above, the retention lip 1002 is not present at the insertion indent 512 which is the only location to insert and remove the balance object or ball of an optimal diameter. Alternate embodiments may not have a retention lip 1002. When a balance object or ball of a preselected range of diameters is used in the channel 914, over half of the balance object or ball will be inside the channel 914 and the retention lip 1002 will align with the balance object or ball at a section that is smaller than its maximum diameter.

Figure 11:
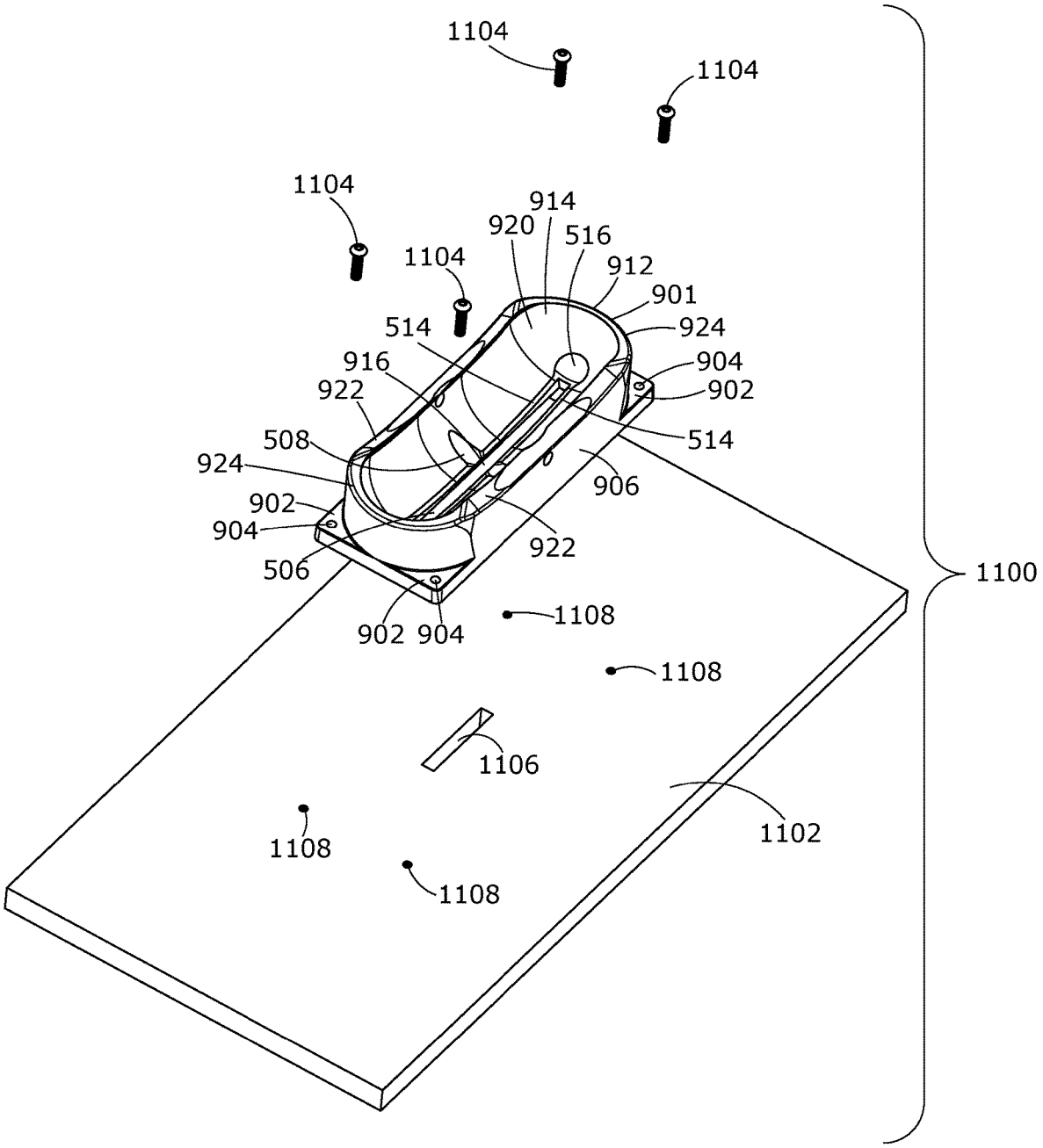
FIG. 11 is an exploded isometric view of a profile with a platform body to form a balance board.

FIG. 11 is an exploded view 1100 of the profile body 901 attached to a balance platform or platform body 1102. In this instance the balance platform or platform body 1102 is a piece of plywood that is approximately 24 inches long, 12 inches wide and 0.75 inches thick. In alternate embodiments the balance platform or platform body 1102 may have different dimensions and/or shape and be made of different materials. The platform body 1102 has a cut out 1106 that lines up with the viewing slot of the profile 506. Note that the cut out 1106 in the board does not have to match the viewing slot of the profile 506 in size or placement but there must be enough physical and visual overlap that the user can watch the movement of the balance object or ball in the channel 914. Alternate embodiments may have a balance platform or platform body 1102 without a cut out 1106.

In the illustrated embodiment the profile body 901 is attached to the bottom of the balance platform or platform body 1110 with four button head socket cap screws 1104 but any attachment device or method such as a screw, rivet, glue, epoxy, nails, etc. may be used that produces acceptable results. The four-button head socket cap screws 1104 extend through the holes of the fastener wings 904 into corresponding holes 1108 on the balance platform or platform body 1102.

The profile body 901 may be made by thermoforming or cast in plastic or metal or injection molded, thermoformed, or any other process that produces acceptable results. If the profile body 901 is thermoformed, ABS may be used. The profile body 901 must be able to support the user's weight. Any other material may be used that produces acceptable results.

Figure 12A:
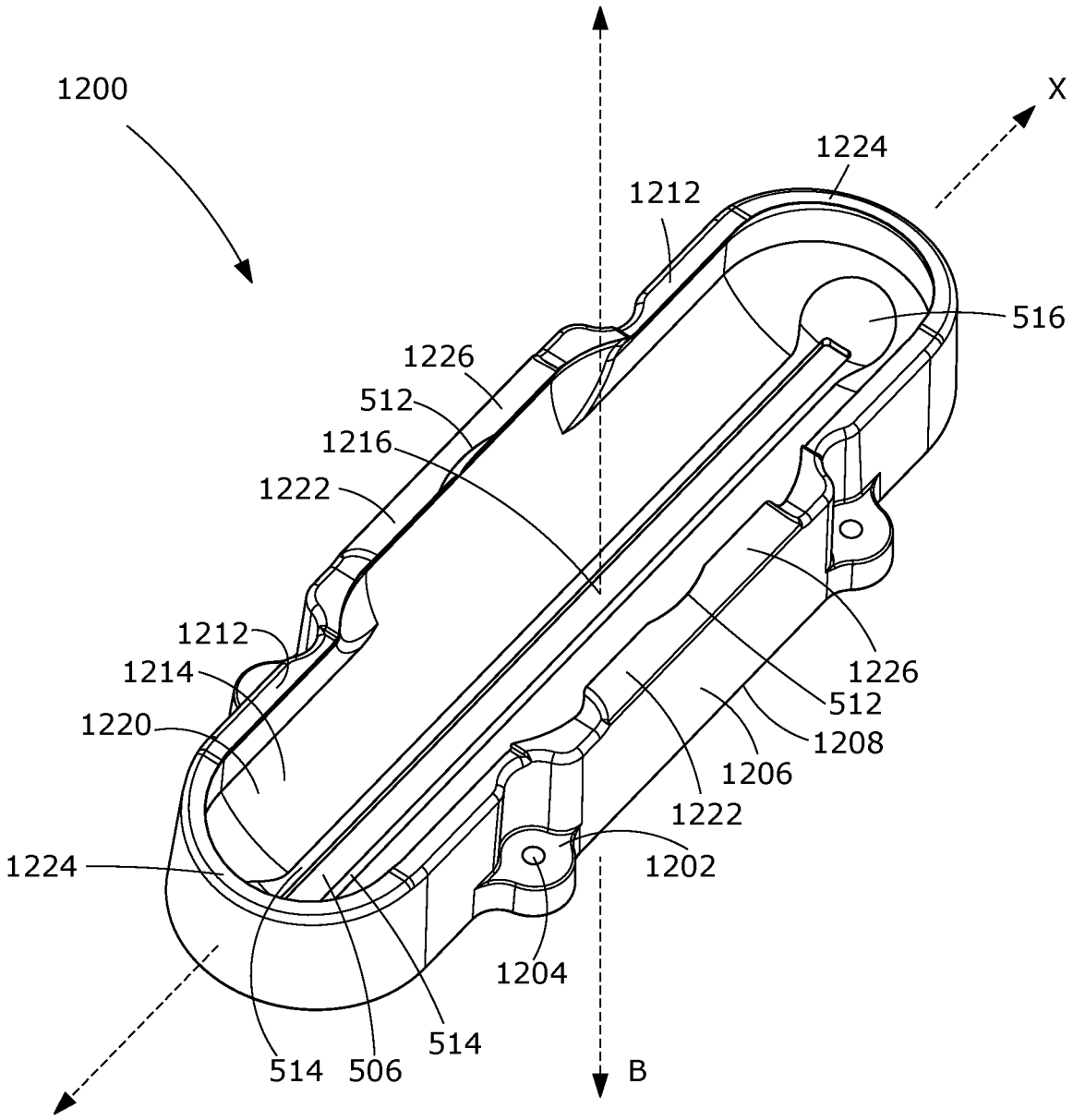
FIG. 12A is a bottom isometric view of an alternate profile according to the invention.
Figure 13A:
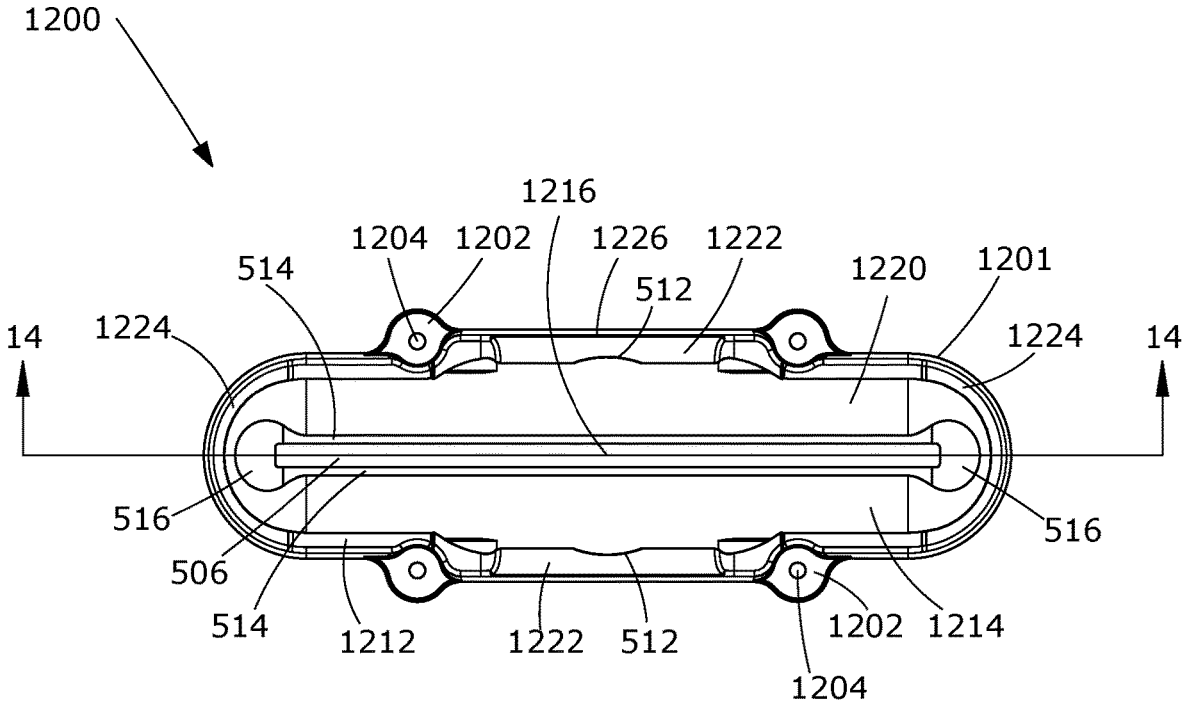
FIG. 13A is a bottom plan view of the profile shown in FIGS. 12A and 12B.

The embodiment illustrated in FIGS. 12A and 13 is an alternate embodiment of a profile 1200 (shown from the bottom) that can be removeably or permanently attached to a platform body or balance platform or create a balance board. The profile 1200 accepts a substantially spherical balance object or ball and the platform body 1201 has a balance midpoint 1216 substantially in alignment with the vertical axis or balance axis B. The balance midpoint is located at the approximate location of the center of gravity or the point at which the profile 1200 would be in a state of equilibrium if balanced at that point.

The profile 1200 has an outer profile wall 1206 and substantially planar upper profile surface 1208 (See FIG. 12 B) that are substantially a pill shape. In alternate embodiments the upper profile platform 1208 may have a different shape as long as it provides acceptable results. In the illustrated embodiment the platform body 1201 is approximately 12.75 inches long and 4.25 inches wide. Alternate embodiments may be larger or smaller. The profile 1200 has four fastener wings 1202, each with a fastener hole 1204, disposed along each long side. The holes of the fastener wings may accept rivets, bolts, screws, nails, or any other connector that fastens the profile body 1201 to a selected balance platform or platform body. Alternatively, a glue or epoxy or other fastening method may be used. Alternate embodiments may have more or fewer fastener wings 1202 and they may be place in different positions.

A channel 1214 depends upwardly from a lower profile surface 1212 along a longitudinal axis. At least a portion of the channel 1214 encompasses the balance midpoint 1216 and is in alignment with a longitudinal axis. The lower profile surface 1212 has two substantially straight lower profile surface sections 1222 and two curved lower profile surface sections 1224. A bump out 1226 encompasses a portion of the straight lower profile surface section 1222 and outer profile wall 1206. The bump out 1226 extends laterally approximately 0.25 inches from adjacent straight lower profile surface section 1222 and adjacent sections of the outer profile wall 1206. In the illustrated embodiment the bump out 1226 has a length that is approximately 50% of the entire length of the straight segments of the outer profile wall 1206. Alternate embodiments may have bump outs 1226 of different lengths.

A continuous curved channel wall 1220 joins the straight lower profile surface sections 1222 and the curved lower profile surface sections 1224. The channel wall 1220 does not have a uniform curvature—the curvature of the channel wall 1220 is dictated, in part, by the bump out 1226. The effect of the bump out 1226 is that balance objects with larger diameters are limited to longitudinal travel in the area of the channel that corresponds to the bump out 1226. Balance objects with smaller diameters travel the full length of the channel. The ability to limit the range of motion of the balance objects helps the user fully develop balance skills. The user can start with a larger balance object that travels a limited section of the channel 1214, and when mastered, the user can use a smaller balance object that travels the entire length of the channel 1214. Importantly, there is no "one" diameter of balance object or ball that fits the channel 1214, but a range of diameters. In the illustrated embodiment the optimal balance object or ball size for the area of the channel corresponding to the bump out 1226 is approximately 0.5 inch greater than the optimal balance object or ball size for a balance object or ball that through the entire range of the channel 1214. In the illustrated embodiment the area of the channel corresponding to the bump out 1226 accommodates balls approximately 3 inches diameter while the entire span of the channel 1214 accommodates balls approximately 2.5 inches diameter.

The channel 1214 may be featureless, in essence a smooth continuous curved wall. The channel 1214 and profile 1200 may have some, all, or none of the features discussed above in reference to FIGS. 1-11. As illustrated the channel 1214 has a viewing slot 506 that extends through the upper profile surface 1208. For the viewing slot 506 to be functional, it would need to line up with an opening or transparent section on the balance platform or platform body to which the profile 1200 is attached. The channel has an insertion indent 512 disposed on opposing sides of the lower profile surface 1212 in substantial alignment with the balance midpoint 1216. A channel rest 516 is disposed in each opposing longitudinal end of the channel wall 1220. The viewing slot 506 in the illustrated embodiment is approximately 10.5 inches long and 0.25 inches wide but alternate embodiments may have viewing slots 506 with different sizes. Stability grooves 514 are longitudinally disposed on either side of the viewing slot 506. Each stability groove is approximately 0.125 inches wide and 11 inches long. The span of the viewing slot 506 and the two stability grooves 514 is approximately 0.5 inch.

Figure 12B:
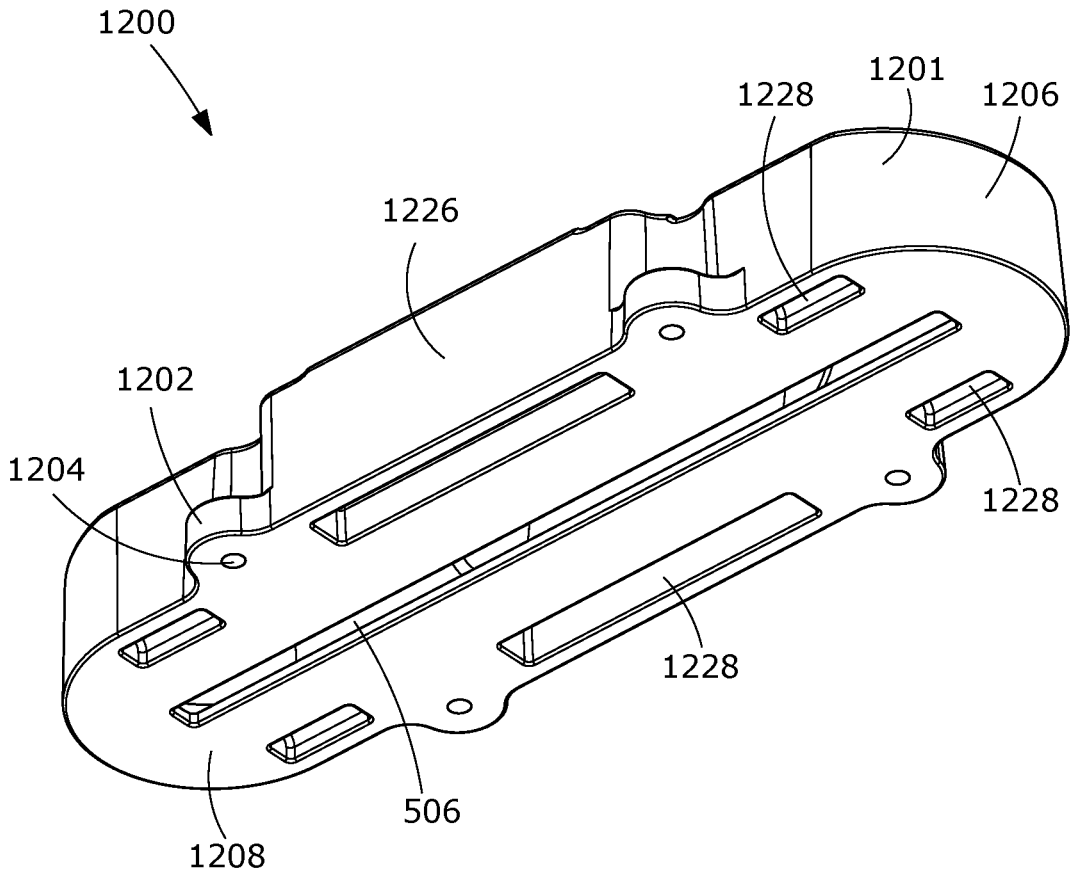
FIG. 12B is a top isometric view of the profile shown in FIG. 12A.

FIG. 12B illustrates the profile 1200 as viewed from the top. The upper profile surface 1208 has fastener holes 1204 for securing the profile 1200 to the balance board or platform body. There are several molding holes 1228 that are formed during the molding process and reduce the weight of the profile 1200. Alternate embodiments may have molding holes 1228 with different placement, sizes, and shapes.

Figure 13B:
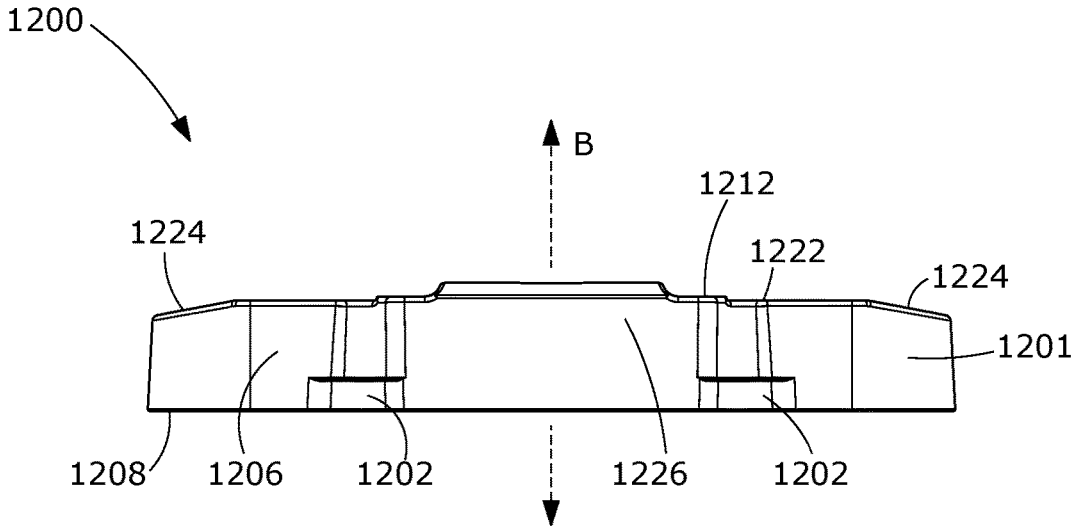
FIG. 13B is a side view of the profile shown in FIGS. 12A and 12B.

As illustrated in FIG. 13B, the lower profile surface 1212 is not planar. The segments of the straight lower profile surface sections 1222 that correspond to the bump out 1226 have a distance from the upper profile platform of approximately 1.9 inches. In comparison, the segments of the straight lower profile surface sections 1222 outside of the bump out 1226 have a distance from the upper profile platform of approximately 1.75 inches. The curved lower profile surface sections 1224 are not coplanar with the straight lower profile surface sections 1222. Portions of the curved lower profile surfaces 1224 have an upward slope when compared to the upper profile surface 1208. The slope ensures that the profile 1200 and/or platform body (when the profile 1200 is attached to a platform body) does not hit the ground when the balance object or ball is at either of the opposing longitudinal ends of the channel wall 1220 without the diminishing the full range of the balance board.

Figure 14:
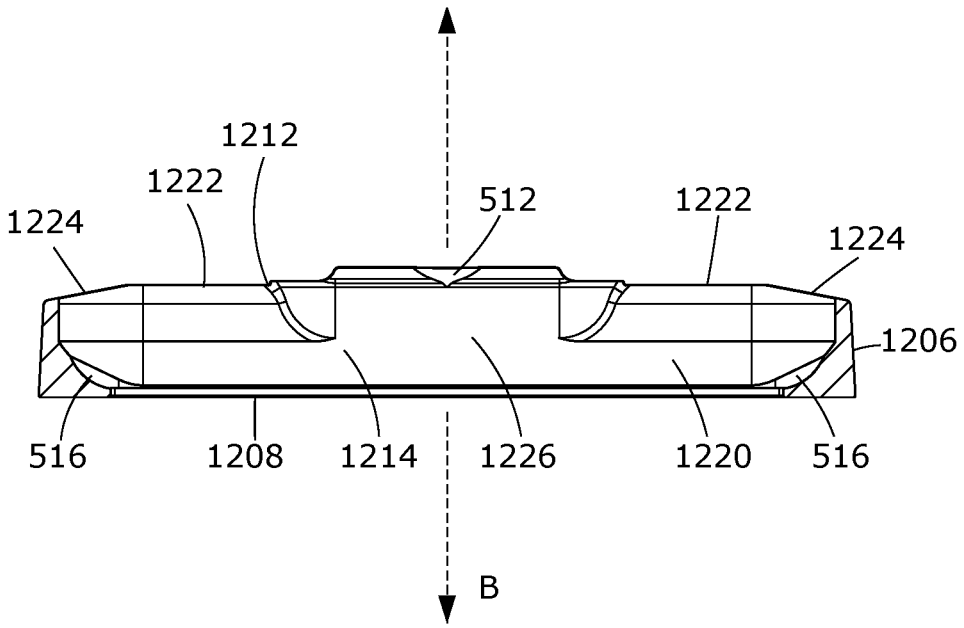
FIG. 14 is a sectional view taken substantially along the line 14-14 of FIG. 13A.

In a cross-sectional view of the profile 1200 illustrated in FIG. 14 the shape of the bottom channel wall 1220 is substantially flat. A channel rest 516 is disposed in each longitudinal end of the channel wall 1220.

Figure 15A:
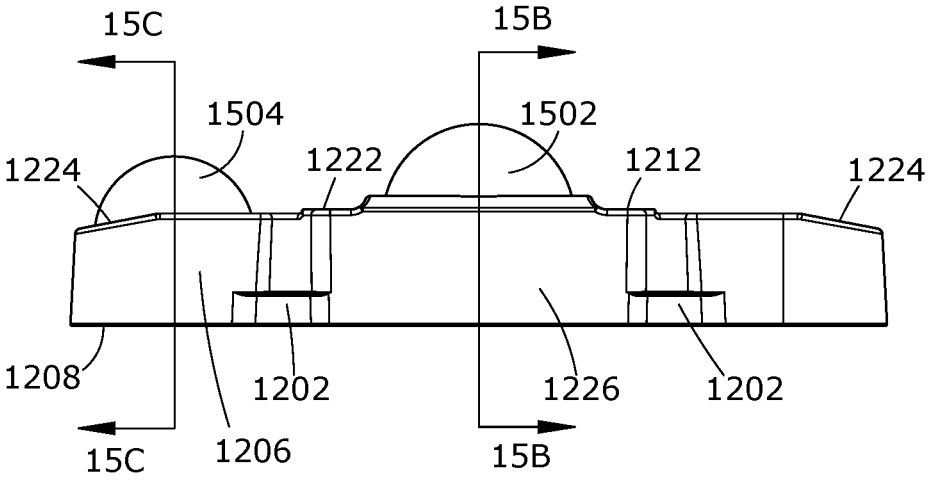
FIG. 15A is a side view of the profile shown in FIGS. 12A and 12B with two balls in the channel.

FIG. 15A illustrates the profile 1200 with two balls 1502, 1504 of equal size (approximately 2.5 inches) in the channel 1214. Ball 1502 is in the bump out 1226 and ball 1504 is at one longitudinal end of the channel 1214. Both balance objects 1502, 1504 are in a position in which the balance object extends from the profile so that the user can balance on the balance object while using the balance board producing satisfactory results.

Figure 15B:
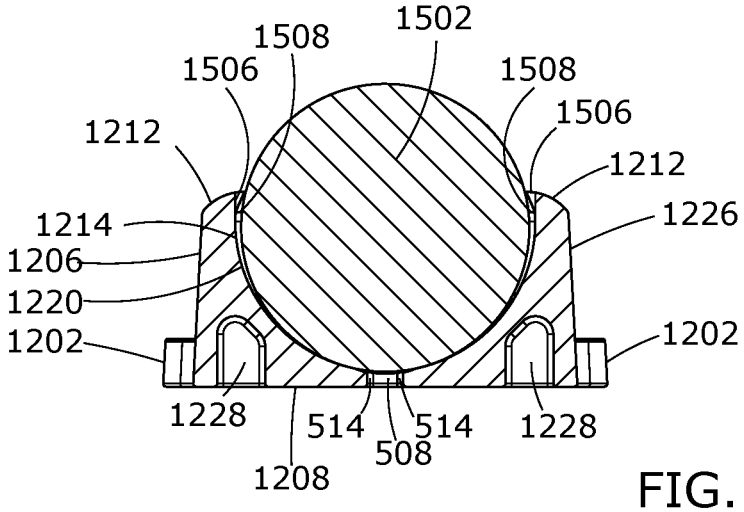
FIG. 15B is a sectional view taken substantially along the line 15B-15B of FIG. 15A.
Figure 15C:
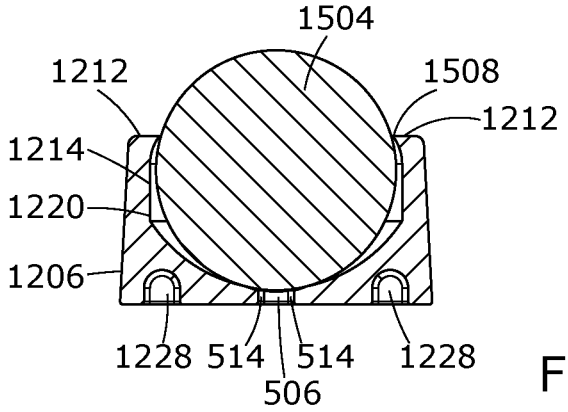
FIG. 15C is a sectional view taken substantially along the line 15C-15C of FIG. 15A.

FIG. 15B is a cross section with a ball 1502 with a 2.5-inch diameter in the bump out 1226. Because the bump out 1226 can accommodate a ball of a 3.0-inch diameter, the ball 1502 does not nest in the channel wall 1220. The bump out retention lip 1506, the extension of the lower profile surface 1212 and the channel wall 1220, does not retain the 2.5-inch diameter ball in the channel 1214 but would retain a 3.0-inch ball in the channel. In comparison, as illustrated in FIG. 15C, ball 1504, also a ball with a 2.5-inch diameter, is retained in the channel 1214 by the retention lip 1508. Alternate embodiments may not have a retention lip 1506, 1508. The retention lip 1506, 1508 aligns with the balance object or ball at a section that is smaller than its maximum diameter.

The profile body 1201 may be made by thermoforming or cast in plastic or metal or injection molded, thermoformed, or any other process that produces acceptable results. If the profile body 1201 is thermoformed, ABS may be used. The profile body 1201 must be able to support the user's weight. Any other material may be used that produces acceptable results.

Figure 16:
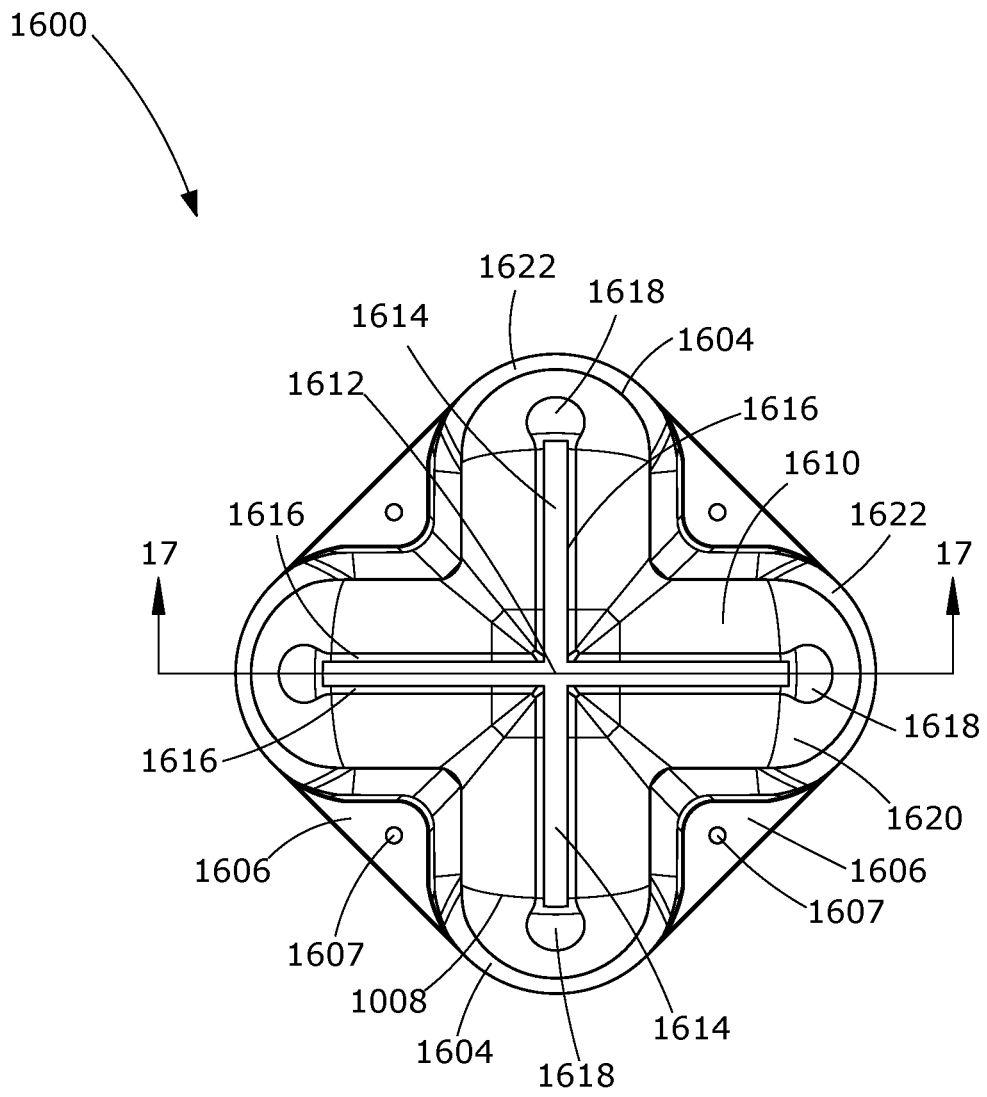
FIG. 16 is a bottom isometric view of an alternate profile according to the invention.
Figure 17:
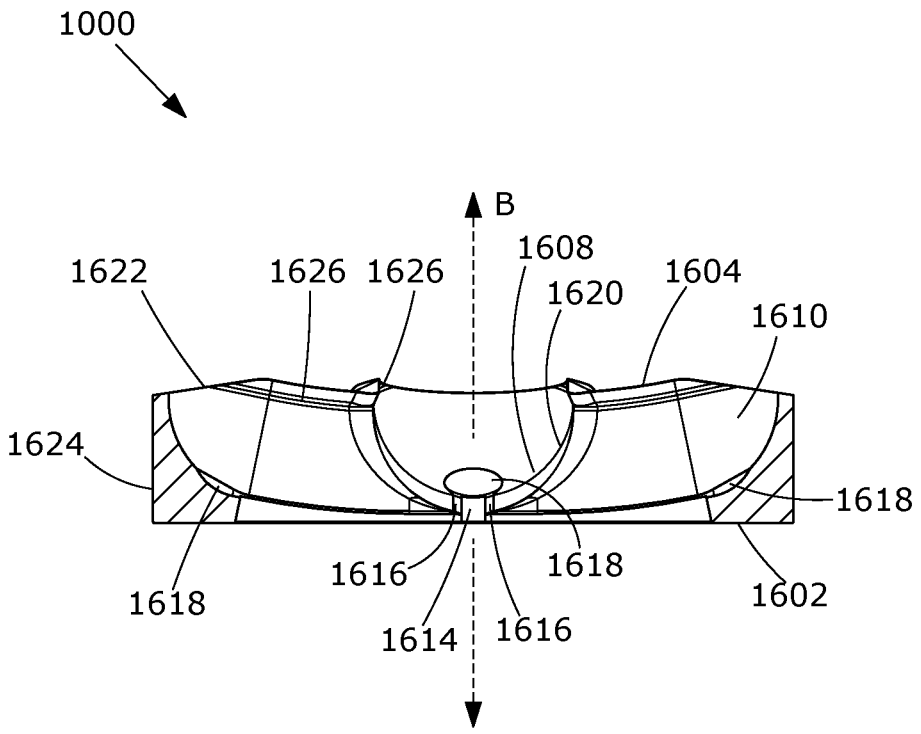
FIG. 17 is a sectional view taken substantially along the line 17-17 of FIG. 16.

FIGS. 16 and 17 illustrate yet a further embodiment of a profile 1600 (shown from the bottom) that can be removeably or permanently attached to a platform body or balance platform to create a balance board. The profile 1600 accepts a substantially spherical balance object or ball. The profile 1600 has a balance midpoint substantially in alignment with the vertical axis or balance axis B. The balance midpoint 1612 is located at the approximate center of gravity or the point at which the profile 1600 would be in a state of equilibrium if balanced at that point.

The profile 1600 has an upper profile panel 1602 that is substantially square with rounded corners. The upper profile panel 1602 has four fastener wings 1606 that are disposed in the space between adjacent rounded corners. A fastener hole 1607 is disposed in each fastener wing 1606 In the illustrated embodiment each side of the upper profile panel 1602 is approximately 8.2 inches long. In alternate embodiments the upper profile panel 1602 may have a different shape and/or size and fastener wings 1606 in different locations. A lower profile surface 1604 forms a rounded plus sign with four equal "arms" at right angles to each other.

In the illustrated embodiment two channels 1608, 1610 depend upwardly from the lower profile surface 1604. The channels 1608, 1610 cross at right angles to each other and the centers of each of the channels 1608, 1610 meet at approximately the balance midpoint 1612. Alternate embodiments may have more than two channels 1608, 1610. Each of the channels 1608, 1610 a viewing slot 1614, stability grooves 1616, and channel rests 1618. For the viewing slot to be functional, the platform body used with the profile 1600 must have a corresponding viewing slot overlapping at least some of the viewing slot 1614. Alternate embodiments may have all, some, or none of these features. A continuous curved channel wall 1620 joins the lower profile surface 1604. The curvature of the channel wall 1620 is sized to accept a preselected group of balance objects or balls with predetermined diameters. In the illustrated embodiment, the channel accepts a ball with a diameter of approximately 3 inches.

FIG. 17A illustrates the cross section taken along lines A-A of FIG. 16. The lower profile surface 1604 has a section where the surface angles upwardly (downwardly in drawing). As discussed for the one channel profile above, the angle of the lower profile surface 1604 allows for full movement of the balance board.

Figure 18:
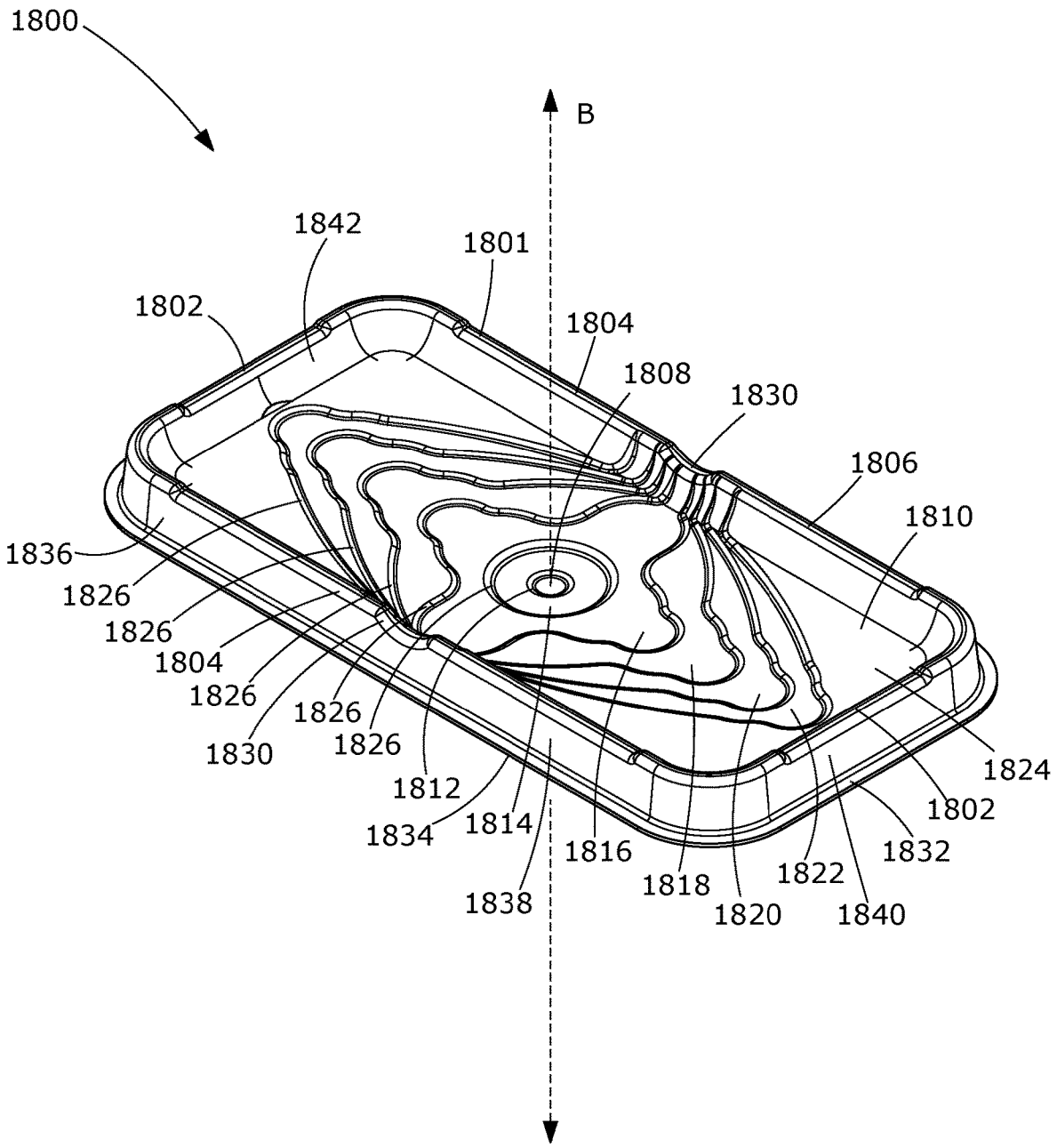
FIG. 18 is a bottom isometric view of an alternate profile according to the invention.
Figure 19A:
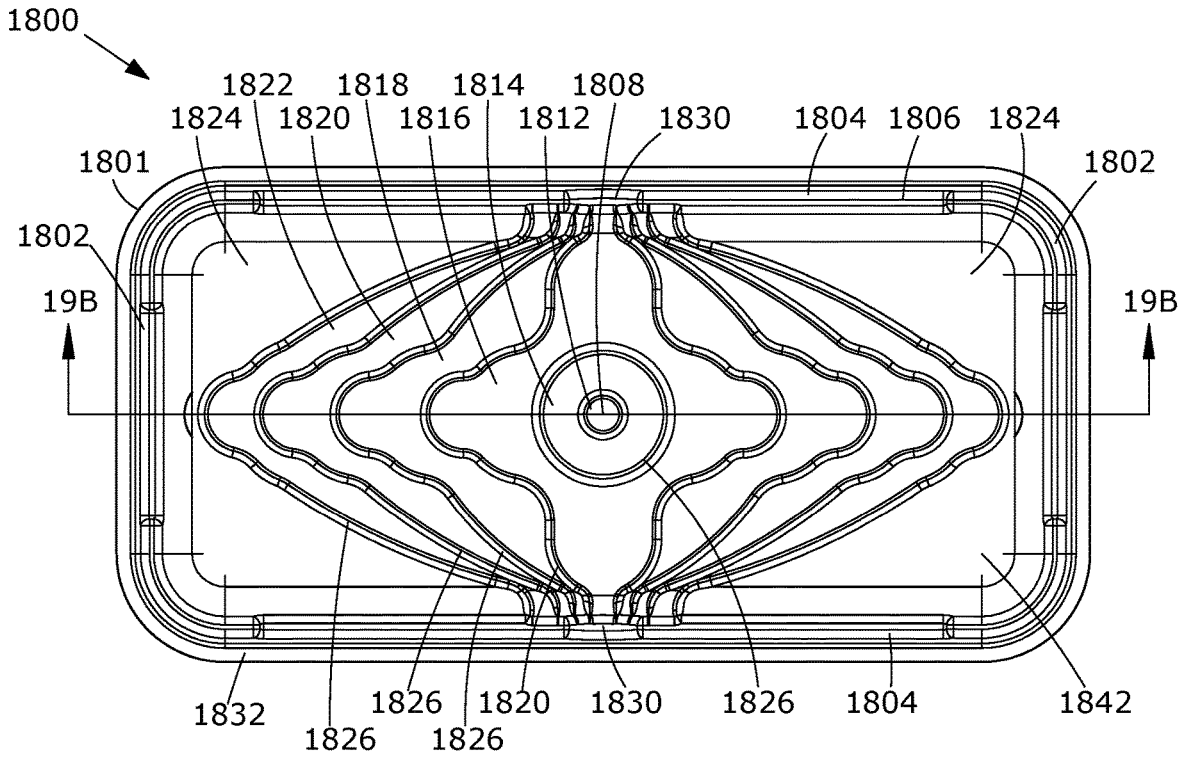
FIG. 19A is a bottom plan view of the profile shown in FIG. 18.
Figure 19B:
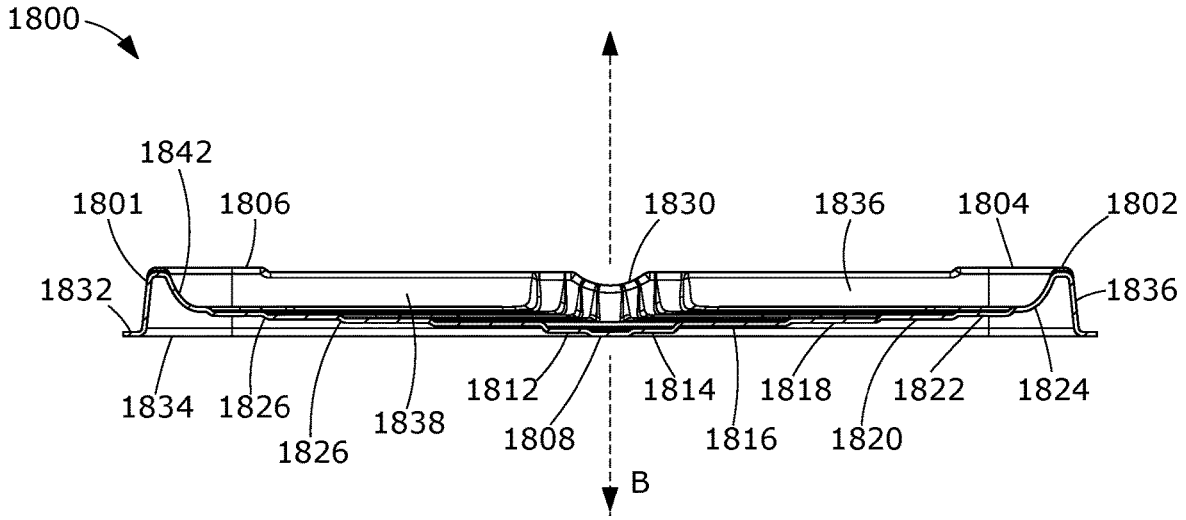
FIG. 19B is a sectional view taken substantially along the line 19B-19B of FIG. 19A.

FIG. 18 illustrates a profile 1800 (shown from the bottom) that accepts substantially spherical balance objects, cylindrical rods, or ovoid cylinders of a wide range of diameters. The profile can be removably or permanently attached to a variety of platform bodies or balance platforms to form a balance board. In some embodiments an upper profile surface 1834 may be used as a balance platform. The profile body 1801 has a balance midpoint 1808 substantially in alignment with the vertical axis or balance axis. The balance midpoint 1808 is located at the approximate location of the center of gravity or the point at which the profile 1800 would be in a state of equilibrium if balanced at that point.

The upper profile surface 1834 has a substantially rectangular shape. The profile 1800 has a profile outer wall 1836 with two exterior longitudinal panels 1838 and two exterior transverse panels 1840. In the illustrated embodiment the longitudinal panels 1838 are approximately 13.75 inches and the transverse panels 1840 are approximately 27 inches. Alternate embodiments may have a longitudinal panel 1838 and transverse panels 1840 with different measurements if acceptable results are achieved. The two exterior longitudinal panels 1838 and two exterior transverse panels 1840 transition to a general lower profile surface 1806. A channel 1810 depends upwardly from a lower profile surface 1806. At least a portion of the channel 1810 encompasses the balance midpoint 1808 along the balance axis. The lower profile surface 1806 has two longitudinal lower profile surface sections 1804 and two transverse lower profile surface sections 1802. A continuous channel wall 1842 joins the longitudinal lower profile surface sections 1804 and transverse lower profile surface sections 1802.

Figure 21A:
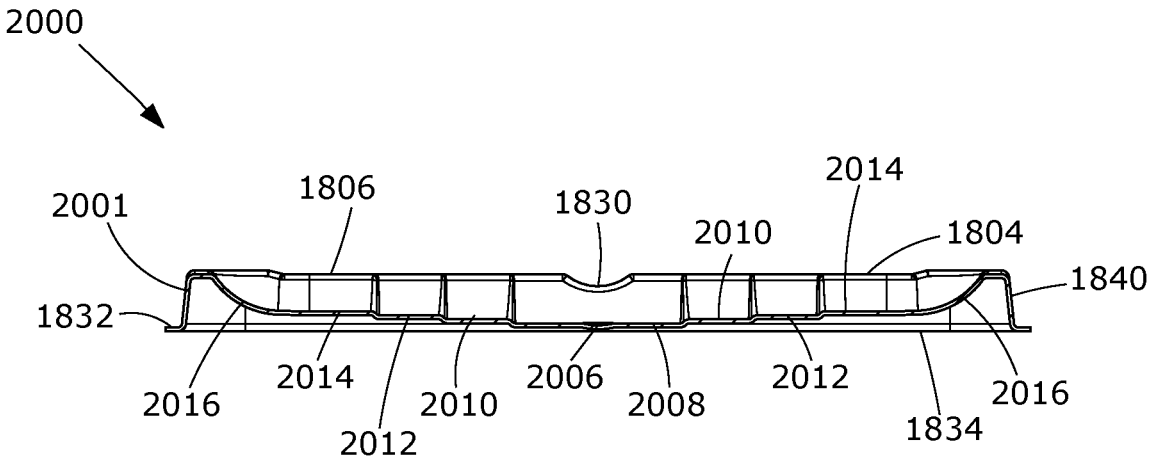
FIG. 21A is a sectional view taken substantially along the line of 21A-21A of FIG. 20B.
Figure 21B:
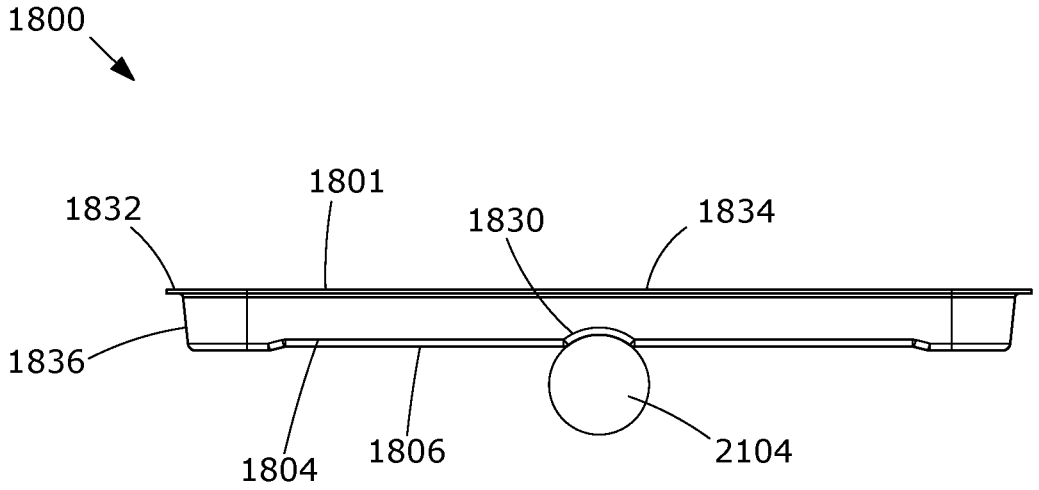
FIG. 21B is a side view of the profile shown in FIGS. 20A and 20B with a balance rod.

In the illustrated embodiment there are two semi-circular notches 1830 disposed in opposing sections of each of the longitudinal lower profile surfaces 1802. The semi-circular notches 1830 accept a cylindrical rod of a predetermined diameter for stationary balancing or semi-stationary balancing as shown in FIG. 21. The semi-circular notches 1830 are identically sized with a diameter of approximately 3.125 inches. Alternate embodiments may have different sizes of notches 1830 if acceptable results are achieved. In practice a rod that is at least as wide as the profile, preferably two or more inches wider, may be placed in opposing semi-circular notches 1830 for stationary balancing. (See FIG. 21B) The rod would be parallel to the transverse panels 1840. In the illustrated embodiment the rod would preferably have a diameter of 3 inches to nest comfortably in the notches 1830.

The outer profile walls have an attachment lip 1832. The attachment lip 1832 radiates at an approximate right angle to the outer profile walls 1836 and can be used to attach the profile 1800 to a platform body or balance platform to create a balance board.

In a first embodiment of the profile illustrated in FIG. 18, the channel 1810 is formed primarily of layers 1812, 1814, 1816, 1818, 1820, 1822, and 1824. Layers 1816, 1818, 1820, and 1822 are shaped like elongated curly brackets. Each layer 1812, 1814, 1816, 1818, 1820, 1822, and 1824 has a continuous edge 1826 which may be a blunt edge or, as illustrated, may gradually taper to the next layer. At least a portion of the center layer 1812 encompasses the balance midpoint 1808 and is the layer closest to the upper profile surface 1834.

In the illustrated embodiment the first layer 1814 is adjacent and lower (lower meaning closer to the lower profile surface 1806) than the center layer 1812. The second layer 1816 is adjacent and lower than the first layer 1814. The third layer 1818 is adjacent and lower than the second layer 1816. The fourth layer 1820 is adjacent and lower than the third layer 1818. The fifth layer 1822 is adjacent and lower than the fourth layer 1820. The sixth layer 1824 is adjacent and lower than the fifth layer 1822. In the illustrated embodiment the vertical measurement of each of the layers is approximately 0.125 inch. Alternate embodiments may have vertical measurements that are greater or smaller than 0.125 inch. Alternate embodiments may have more or fewer layers and layers of different shapes.

In use the shape and placement of the layers allows spherical balance objects, cylindrical rods, or ovoid cylinders of a wide range of diameters to self-center into the center layer 1812 during use. For example, if a ball is being used as a balance object, when the ball is in motion, there is a natural tendency for the ball to travel back to the center layer 1812. The ball can start anywhere on the sixth layer 1824 and while the balance board is being used, the ball would travel via the channel 1810 to eventually settle at the center layer 1812. The self-centering feature of the channel 1810 provides stability for the user.

Importantly, unlike the channels discussed in previous embodiments, the instant channel 1810 accepts spherical balance objects of any diameter that produces acceptable results. This is especially beneficial when the user already has a spherical balance object available. For example, if the user plays tennis, the user may use a tennis ball as the balance object; if the user plays baseball, the user may use a baseball as the balance object; if the user plays basketball, the user may use a basketball as the balance object; if the user plays soccer, the user may use a soccer ball as the balance object. The examples are not meant to be limiting but simply demonstrate the ease at which a balance object may be selected for the illustrated channel 1810. Additionally, the balance object or ball would need to fit within the channel 1810 safely and be able to bear the weight of the user.

Figure 20A:
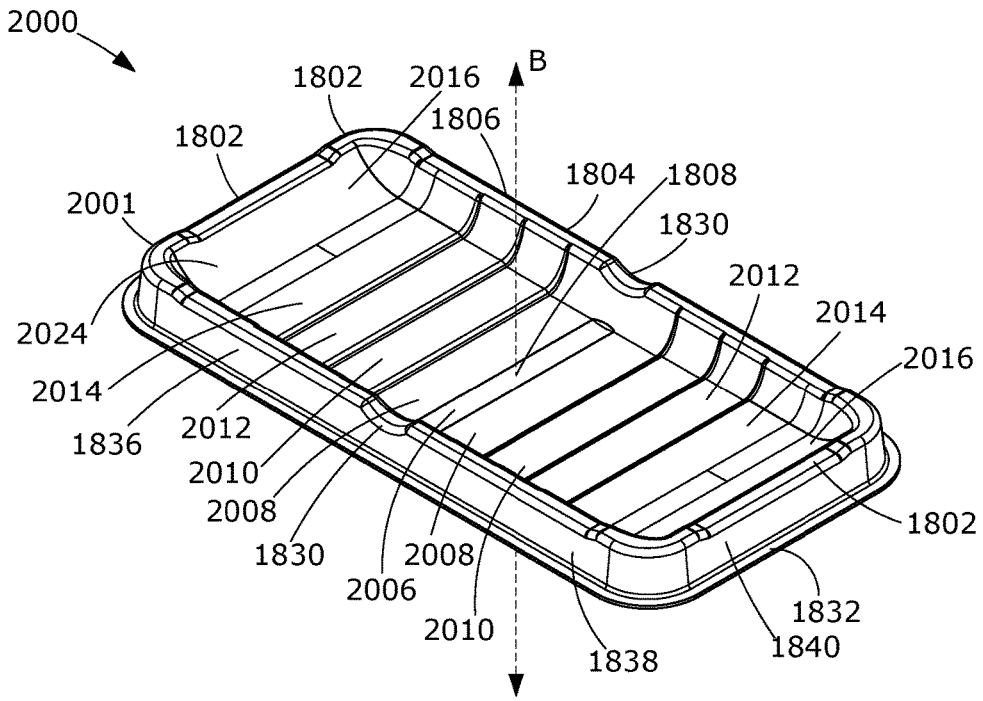
FIG. 20A is a bottom isometric view of an alternate profile according to the invention.
Figure 20B:
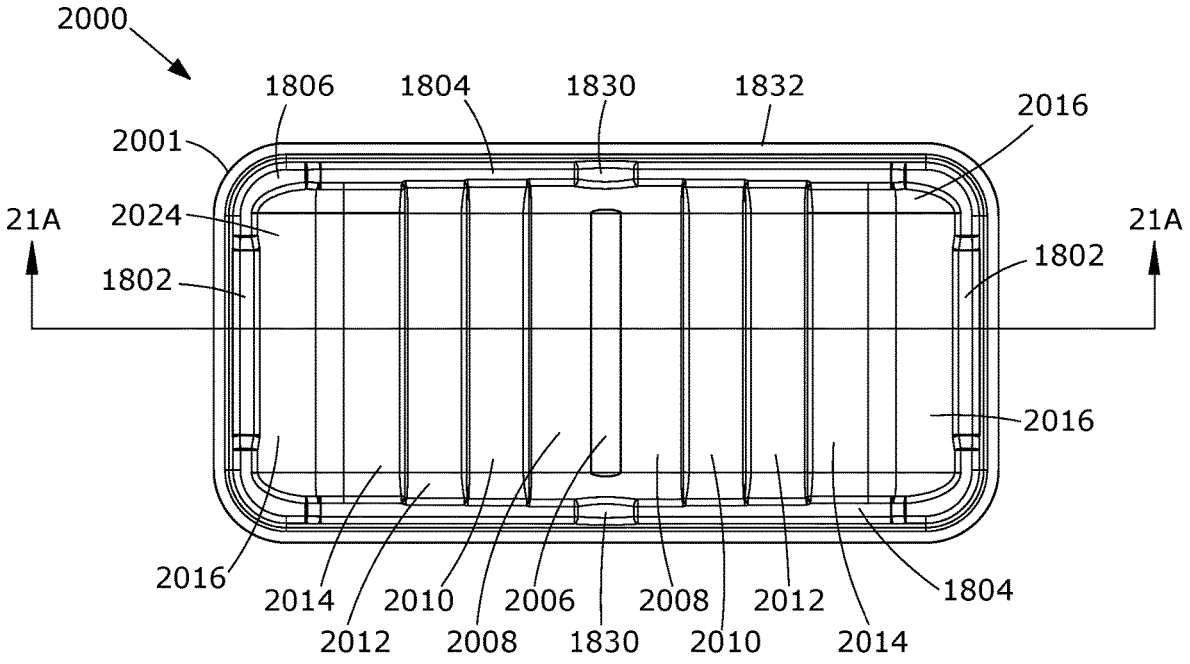
FIG. 20B is a bottom plan view of the profile shown in FIG. 20A.

In a second embodiment of the channel 2016 illustrated in FIGS. 20A and 20B, the channel 2016 has a broad, almost flattened area which extends almost the full width of the profile 1801 with curved transitions and sloped walls transitioning to the lower profile surface 1806. The channel 2016 has continuous curved wall 2024 that has periodic lateral segments 2006, 2008, 2010, 2012, 2014. As illustrated, there are seven segments 2006, 2008, 2010, 2012, 2014 (three segments on either side of a center segment 2006). Alternate embodiments may have a different number of segments of varying sizes. Each of the segments 2006, 2008, 2010, 2012, 2014 extends laterally to opposed longitudinal sides 1804.

A first or center channel wall segment 2006 encompasses the center portion of the channel wall and includes the midpoint 1808. In the illustrated embodiment the center channel wall segment 2008 is approximately 2.125 inches wide and is located in the approximate longitudinal center of the channel wall. The segments extend laterally from the center channel wall segment 2008 to the lateral sides 1802. In each segment, the majority of the channel wall 2024 is substantially flat. A longitudinal center rest 2006 is formed in the center channel wall segment 2008.

On either side of the center channel wall segment 2008 are second channel wall segments 2010. The second channel wall segments are approximately 2.125 inches wide and approximately 0.125 inches deep. Adjacent the second channel wall segments are third channel wall segments 2012. The third channel wall segments 2012 are approximately 2.125 inches wide and approximately 0.125 inches deep. Adjacent the third channel wall segments are fourth channel wall segments 2014. The fourth channel wall segments 2014 are approximately 2.125 inches wide and approximately 0.125 inches deep. As illustrated in FIG. 21A, the transition between the first, second, third, and fourth channel wall segments is a step up of approximately 0.125 inch. The channel wall transitions create a ramp-like effect which moves the balance object towards the center channel wall segment. Additionally, the width of the channel wall segments allows for the use of rod-shaped balance objects. Alternate balance objects that may be used may be ovoid, conical, or spherical.

The profile 1800 may have a viewing slot (not shown) that allows the user to watch the travel of the balance object in the channel 2016. The viewing slot can have any dimensions that do not interfere with the operation of the profile 1800 and provide visibility to the user. If the profile 1800 is attached to a balance platform or platform body, the balance platform or platform body must have a corresponding viewing slot, although not necessarily of identical dimensions.

The profile 1800 can balance on a rod 2104 placed in opposing semi-circular notches 1830. The rod 2104 must be at least as wide as the profile, preferably two or more inches wider. (In the illustrated embodiment the rod 2104 would preferably have a diameter of 3 inches so that the rod nests in the notches 1830.

The profile body 1800 may be made by thermoforming or cast in plastic or metal or injection molded, thermoformed, or any other process that produces acceptable results. If the profile 1800 is thermoformed, ABS may be used. The profile 1800 must be able to support the user's weight. Any other material may be used that produces acceptable results.

While illustrated embodiments of the present invention have been described and illustrated in the appended drawings, the present invention is not limited thereto but only by the scope and spirit of the appended claims.

The invention claimed is:

1. A balance board, the balance board comprising:

a platform body, the platform body having a bottom platform panel and a top platform panel axially spaced from the bottom platform panel;

a channel depending upwardly from the bottom platform panel, at least a portion of the channel disposed at a balance midpoint, the channel in alignment with a longitudinal axis;

the channel having a curvature that retains at least a portion of each of a plurality of spherical balance objects while permitting longitudinal movement within the channel.

2. The balance board of claim 1, wherein a viewing slot is disposed in the platform body.

3. The balance board of claim 1, wherein a center rest is disposed in the channel at the balance midpoint.

4. The balance board of claim 1, wherein at least two stability grooves are disposed in the channel.

5. The balance board of claim 1, wherein at least one channel rest is disposed in the channel.

6. The balance board of claim 1, wherein the channel has a substantially elliptical shape relative to the longitudinal axis.

7. The balance board of claim 1, wherein a retention lip is disposed in the channel.

8. The balance board of claim 1, wherein an insertion indent is disposed on the bottom platform panel.

9. A balance board profile, the balance board profile comprising:

a profile body having an upper profile surface, a lower profile surface axially spaced from the upper profile surface;

a channel depending upwardly from the lower profile surface, at least a portion of the channel disposed at a balance midpoint, the channel in alignment with a longitudinal axis;

the channel having a curvature that retains at least a portion of each of a plurality of spherical balance objects while permitting longitudinal movement within the channel.

10. The balance board profile of claim 9, wherein the profile body has at least one fastener wing.

11. The balance board profile of claim 9, wherein a predetermined section of the channel has a larger curvature.

12. The balance board profile of claim 9, wherein the profile body has two channels, the two channels intersecting at the balance midpoint.

13. The balance board profile of claim 9, wherein a viewing slot is disposed in the upper profile surface.

14. The balance board profile of claim 9, wherein a center rest is disposed in the channel at the balance midpoint.

15. The balance board profile of claim 9, wherein at least two stability grooves are disposed in the channel.

16. The balance board profile of claim 9, wherein at least one channel rest is disposed in the channel.

17. The balance board profile of claim 9, wherein the channel has a substantially elliptical shape relative to the longitudinal axis.

18. The balance board profile of claim 1, wherein a retention lip is disposed in the channel.

19. The balance board profile of claim 9, wherein an insertion indent is disposed on the lower profile surface.

20. A balance board profile, the balance board profile comprising:

a profile body having an upper profile surface, a lower profile surface axially spaced from the upper profile surface;

a channel depending upwardly from the lower profile surface, the channel having two channel longitudinal sides, two channel lateral sides and a plurality of channel layers extending between the longitudinal sides, the channel allowing a plurality of balance objects to have longitudinal and lateral movement within the channel;

a center channel layer disposed in lateral alignment with a balance midpoint, each of the remaining plurality of layers disposed such that each of the plurality of balance objects travel to the center channel layer.

21. The balance board profile of claim 20, wherein each of the plurality of channel layers is substantially rectangular.

22. The balance board profile of claim 20, wherein the plurality of channel layers is adapted to accept a cylindrical rod.

23. The balance board profile of claim 20, wherein the plurality of channel layers is adapted to accept a sphere.

24. The balance board profile of claim 20, wherein a notch is disposed in each of the channel longitudinal sides in substantial alignment with the balance midpoint.

25. The balance board profile of claim 20, wherein a center rest is disposed in the channel at the balance midpoint.

* * * * *